US009476204B2

(12) United States Patent
Wolf

(10) Patent No.: US 9,476,204 B2
(45) Date of Patent: Oct. 25, 2016

(54) BOXED NETTING INSULATION SYSTEM FOR ROOF DECK

(71) Applicant: Owens Corning Intellectual Capital, LLC, Toledo, OH (US)

(72) Inventor: David H. Wolf, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/452,696

(22) Filed: Aug. 6, 2014

(65) Prior Publication Data

US 2015/0218802 A1 Aug. 6, 2015

Related U.S. Application Data

(60) Provisional application No. 61/935,111, filed on Feb. 3, 2014.

(51) Int. Cl.

| | |
|---|---|
| ***E04B 1/74*** | (2006.01) |
| ***E04B 1/76*** | (2006.01) |
| ***E04D 13/16*** | (2006.01) |

(52) U.S. Cl.

CPC ..... *E04D 13/1637* (2013.01); *E04B 1/7658* (2013.01); *E04B 1/74* (2013.01); *E04B 1/7616* (2013.01)

(58) Field of Classification Search

CPC ..... E04B 1/74; E04B 1/76; E04B 1/7616; E04B 2001/8423; E04B 1/7608; E04B 2001/8442; E04B 9/001; E04B 9/04

USPC ..... 52/742.1, 742.12, 404.1, 406.1, 406.2, 52/407.1, 407.2, 407.4, 404.5, 198, 199

See application file for complete search history.

(56) References Cited

U.S. PATENT DOCUMENTS

| | | | | |
|---|---|---|---|---|
| 1,172,379 A | | 2/1916 | Mazer | |
| 1,848,272 A | | 3/1932 | Powell | |
| 1,921,518 A | | 8/1933 | Frobisher | |
| 1,929,751 A | * | 10/1933 | MacDonell | 52/145 |
| 1,937,843 A | | 12/1933 | Clifton | |
| 1,997,581 A | | 4/1935 | Heeren | |

(Continued)

FOREIGN PATENT DOCUMENTS

| | | |
|---|---|---|
| GB | 2449985 | 12/2008 |
| WO | 2008/127936 | 10/2008 |

(Continued)

OTHER PUBLICATIONS

International Search Report and Written Opinion from PCT/US15/014318 dated May 8, 2015.

(Continued)

*Primary Examiner* — Phi A

(74) *Attorney, Agent, or Firm* — Calfee, Halter & Griswold LLP

(57) ABSTRACT

Insulation systems that provide insulation cavities below trusses of residential roofs. The insulation systems are configured to provide insulation material directly below bottommost surfaces of the roof trusses. The insulation systems may include insulation support material that provides insulation pockets below bottommost surfaces of roof trusses. Insulation support material may include side panel segments and span segments. The insulation support material may be attached to the roof trusses or sheathing panels from below the roof trusses and sheathing panels.

26 Claims, 12 Drawing Sheets

(56) References Cited

U.S. PATENT DOCUMENTS

| | | | | |
|---|---|---|---|---|
| 1,997,605 | A | 4/1935 | Strom | |
| 2,112,631 | A * | 3/1938 | MacDonald | E04B 9/001 52/144 |
| 2,330,941 | A | 10/1943 | Acuff, Jr. | |
| 2,476,499 | A | 7/1949 | Lowell | |
| 2,887,733 | A | 5/1959 | Kice | |
| 3,082,487 | A * | 3/1963 | Fowler et al. | 52/145 |
| 3,267,626 | A * | 8/1966 | Daly | E04C 2/08 52/145 |
| 3,304,680 | A * | 2/1967 | Birdwell | E04B 1/30 52/220.3 |
| 3,708,940 | A * | 1/1973 | Harman | E04F 13/18 52/509 |
| 4,135,342 | A * | 1/1979 | Cotter | 52/461 |
| 4,222,212 | A | 9/1980 | Alderman | |
| 4,233,791 | A * | 11/1980 | Kuhl et al. | 52/309.1 |
| 4,319,421 | A * | 3/1982 | Diamond | 40/617 |
| 4,375,741 | A * | 3/1983 | Paliwoda | 52/127.1 |
| 4,437,287 | A * | 3/1984 | Halfaker | E04B 9/0435 52/145 |
| 4,476,659 | A * | 10/1984 | Player | E04D 3/30 52/404.1 |
| 4,566,239 | A | 1/1986 | Smigel et al. | |
| 4,635,423 | A | 1/1987 | Ward | |
| 4,738,072 | A * | 4/1988 | Clemensen et al. | 52/742.12 |
| 4,769,958 | A * | 9/1988 | Limp | 52/39 |
| 4,799,347 | A * | 1/1989 | Byler | E04D 13/1625 52/406.1 |
| 5,242,219 | A * | 9/1993 | Tomaka | 312/245 |
| 5,421,133 | A | 6/1995 | Berdan, II et al. | |
| 5,653,081 | A | 8/1997 | Wenrick et al. | |
| 5,724,780 | A * | 3/1998 | Bolich | 52/407.4 |
| 5,770,295 | A | 6/1998 | Alderman | |
| 5,799,461 | A * | 9/1998 | Dittemore | 52/588.1 |
| 6,185,895 | B1 | 2/2001 | Rettew | |
| 6,221,464 | B1 * | 4/2001 | Patel et al. | 428/192 |
| 6,330,779 | B1 | 12/2001 | Kinzler | |
| 6,397,531 | B1 * | 6/2002 | Martin | 52/220.6 |
| 6,421,980 | B1 * | 7/2002 | Alderman et al. | 52/746.11 |
| 6,444,286 | B1 * | 9/2002 | MacKenzie | 428/99 |
| 6,487,825 | B1 * | 12/2002 | Sillik | E04B 1/7666 248/343 |
| 6,808,772 | B2 | 10/2004 | Kunzel et al. | |
| 6,857,238 | B2 | 2/2005 | Alderman | |
| 6,878,455 | B2 | 4/2005 | Kunzel et al. | |
| 6,890,666 | B2 | 5/2005 | Kunzel et al. | |
| 7,008,890 | B1 | 3/2006 | Kunzel et al. | |
| 7,484,335 | B1 * | 2/2009 | Dunlap | 52/95 |
| 8,176,699 | B1 | 5/2012 | Birchfield | |
| 8,281,548 | B1 | 10/2012 | Garcia | |
| 8,322,111 | B2 | 12/2012 | Near et al. | |
| 8,347,562 | B2 * | 1/2013 | Morris | E04D 13/1631 428/163 |
| 8,615,946 | B2 | 12/2013 | Oberg | |
| 9,032,678 | B2 * | 5/2015 | Shaw et al. | 52/302.1 |
| 9,347,220 | B1 * | 5/2016 | Gaydos | E04B 9/045 |
| 2003/0061776 | A1 * | 4/2003 | Alderman | 52/404.1 |
| 2003/0061777 | A1 | 4/2003 | Alderman | |
| 2003/0215609 | A1 | 11/2003 | Burkart | |
| 2005/0017142 | A1 | 1/2005 | Ogden | |
| 2005/0279050 | A1 * | 12/2005 | Romes | 52/742.1 |
| 2008/0245010 | A1 | 10/2008 | Pollack | |
| 2009/0107068 | A1 | 4/2009 | Fay et al. | |
| 2010/0024325 | A1 | 2/2010 | Robbins et al. | |
| 2011/0036034 | A1 * | 2/2011 | Robinson | 52/404.3 |
| 2012/0232213 | A1 | 9/2012 | Shoemake et al. | |
| 2013/0239502 | A1 | 9/2013 | Robbins et al. | |
| 2013/0280467 | A1 | 10/2013 | Fay | |
| 2013/0292863 | A1 | 11/2013 | Shoemake et al. | |
| 2014/0001396 | A1 | 1/2014 | Tutin et al. | |
| 2014/0094562 | A1 | 4/2014 | Hagiopol et al. | |
| 2014/0154478 | A1 | 6/2014 | Fellinger | |

FOREIGN PATENT DOCUMENTS

| | | |
|---|---|---|
| WO | 2009/098499 | 8/2009 |
| WO | 2011/022668 | 2/2011 |
| WO | 2011/054098 | 5/2011 |
| WO | 2012/138718 | 10/2012 |
| WO | 2012/138723 | 10/2012 |
| WO | 2013/150123 | 10/2013 |
| WO | 2013/163242 | 10/2013 |
| WO | 2013/163245 | 10/2013 |
| WO | 2014/102197 | 7/2014 |

OTHER PUBLICATIONS

Lstiburek, "Understanding Attic Ventilation", Building Science Digest 102, Oct. 26, 2006.

Icynene, the Evolution of Insulation, 2 page web printout, accessed Apr. 2, 2015.

The Sealed Attic System with DuPont Tyvek AttickWrap, Building Science Bulletin, 4 pgs. copyright 2005.

Speed Rod, Insulating Application Products, 2 page brochure, date is at least as early as the filing date of this application.

Office action from U.S. Appl. No. 14/532,302 dated Feb. 18, 2016.

* cited by examiner

BOXED NETTING INSULATION SYSTEM FOR ROOF DECK

RELATED APPLICATIONS

The present application claims the benefit of U.S. Provisional Patent Application Ser. No. 61/935,111, filed on Feb. 3, 2014, titled "Boxed Netting Insulation System for Roof Deck." U.S. Provisional Patent Application Ser. No. 61/935,111 is incorporated herein by reference in its entirety.

BACKGROUND

Buildings, such as for example residential buildings, can be covered by sloping roof decks. The interior portion of the building located directly below the sloping roof decks can form an interior space called an attic. In some instances, the attic can be vented by active or passive systems, such as to replace the air within the attic with fresh air. One recent construction trend is to provide a sealed or unvented attic.

The interior space defining an attic can be formed with structural members, including angled structural members commonly referred to as truss chords. Conventional systems and methods for insulating unvented attics include filling the cavities formed between adjacent truss chords with insulation materials, held in place by a netting. In certain instances the insulation material can be loosefill insulation and the netting can be formed from a fabric. Due to bulging of the netting, the conventional systems can result in a non-uniform insulation thickness and a corresponding inconsistent insulative quality. Also, since the fabric material is commonly fastened to the major faces of the truss chords, portions of the truss chords can be left exposed and uninsulated.

Accordingly, it would be advantageous if systems for insulating an unvented attic could be improved.

SUMMARY

The present application discloses systems for providing insulation cavities below roof trusses. The insulation systems may be configured to provide insulation material directly below bottommost surfaces of the roof trusses.

In one exemplary embodiment, an insulation support material for providing insulation cavities below roof trusses comprises a plurality of interconnecting support portions. Each of the interconnecting support portions comprises a single side panel segment and a single span segment. A width of the single side panel segment is greater than a depth of the truss and a width of the single span segment has a width that substantially matches the predetermined spacing of the trusses. A first tab is provided at a transition from the single side panel segment and the single span segment. A second tab is provided at a free end of the single span segment. The first and second tabs are connectable to provide the insulation cavities.

In one exemplary embodiment, an insulation system includes spaced apart roof trusses, sheathing panels and insulation support material. The sheathing panels are disposed on top of top surfaces of the roof trusses. The insulation support material includes side panel segments and span segments. The side panel segments are attached to and extend past bottommost surfaces of the roof trusses. The span segments are supported below the bottommost surfaces of the roof trusses by the side panel segments. The side panel segments and the span segments define insulation cavities with pockets located directly under the roof trusses. Insulation, such as loose fill insulation, is disposed in the pockets directly under the roof trusses.

In one exemplary embodiment, an insulation system includes spaced apart roof trusses, sheathing panels and insulation support material. The insulation support material is attached to the roof trusses or sheathing panels from below the roof trusses and sheathing panels. Insulation is disposed on the insulation support material directly under bottommost surfaces of the roof trusses.

DETAILED DESCRIPTION OF THE INVENTION

Figure 1:
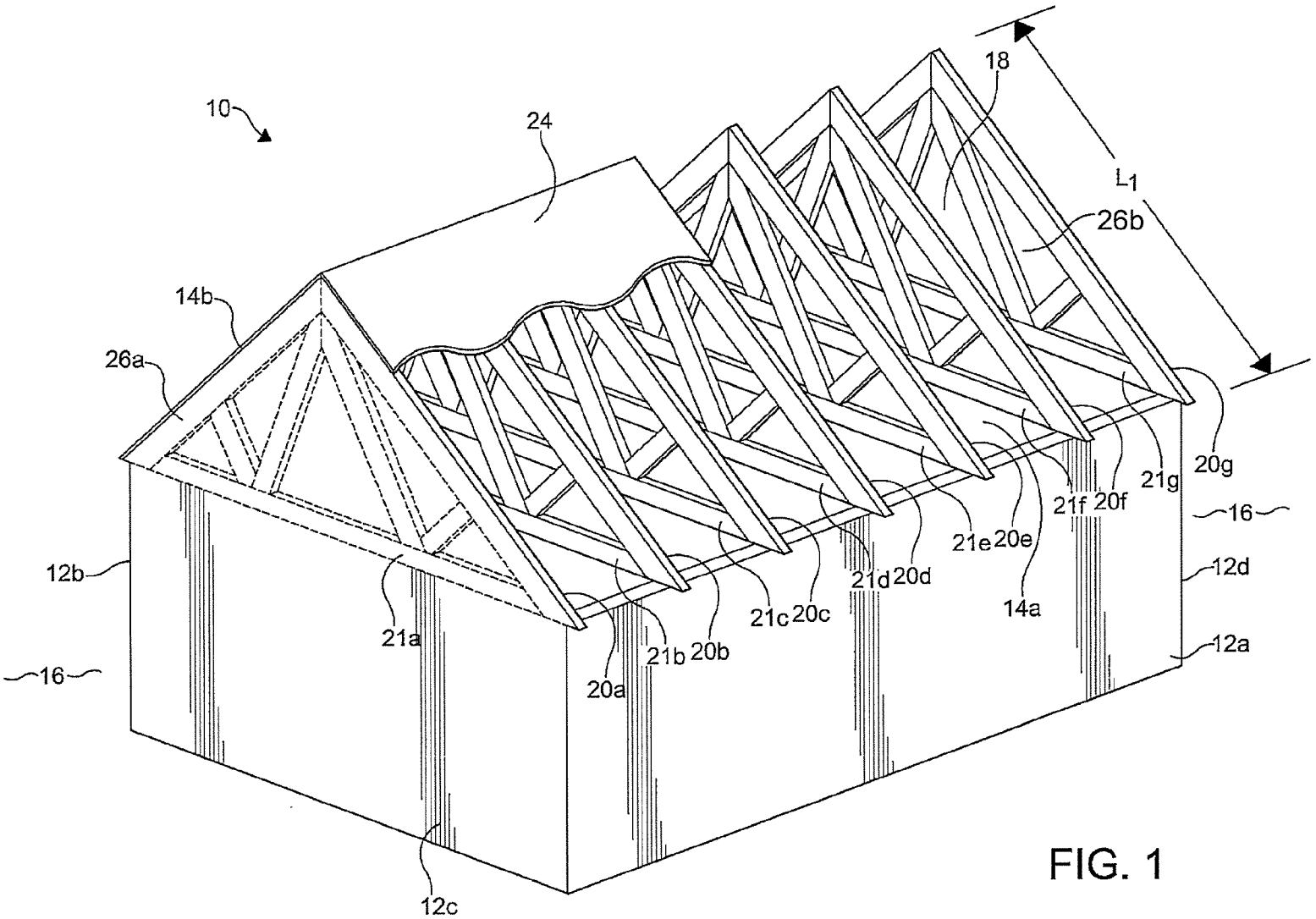
FIG. 1 is a perspective view, partially in phantom, of a building structure illustrating truss chords and insulation cavities formed between adjacent truss chords.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose boxed netting insulation systems for application to interior building spaces located below roof decks. While the descriptions below will discuss and show boxed netting insulation systems for use with sloped roof decks forming an unvented attic, it should be appreciated that the boxed netting insulation systems can be applied to roof decks constituting flat roofs forming an unvented attic. Generally, the boxed netting insulation systems are configured to form an insulation layer having a desired depth and positioned within the attic side of the roof deck, such that the insulation layer has a substantially uniform thickness, has an adjustable thickness and the insulation layer insulates the structural members forming the roof deck.

The terms "roof deck", as used herein, is defined to mean any framework configured to support roofing materials, such as for example, shingles. As used herein, the term "roof deck" can refer to frameworks forming either sloped or flat roofs. The term "attic", as used herein, is defined to mean an interior portion of a building located directly below the roof decks. The term "unvented", as used herein, is defined to mean the absence of active or passive ventilation systems. The term "boxed" as used herein, is defined to mean having the three dimensional shape or form of a box or rectangle. The term "netting", as used herein, is defined to mean any material used to contain insulation material within an insulation cavity. The term "loosefill insulation material" or "loosefill material" or "insulation material", as used herein, is defined to mean any insulation material configured for distribution in an airstream. The term "unbonded", as used herein, is defined to mean the absence of a binder. The term "conditioned", as used herein, is defined to mean the shredding of the loosefill material to a desired density prior to distribution in an airstream.

Referring now to the drawings, there is illustrated in FIG. 1, a first example of a structure, indicated generally at 10. The structure 10 is formed with conventional truss construction (for purposes of clarity, only a few of the trusses are illustrated), and includes exterior walls 12*a*-12*d* and roof decks 14*a*, 14*b*.

The exterior walls 12*a*-12*d* are configured to separate the interior spaces (not shown) of the structure 10 from areas 16 exterior to the structure 10, as well as providing a protective and aesthetically pleasing covering to the sides of the structure 10. The exterior walls 12*a*-12*d* can be formed using any typical construction methods, such as the non-limiting example of stick and frame construction. The exterior walls 12*a*-12*d* can include any desired wall covering (not shown), such as for example brick, wood, or vinyl siding, sufficient to provide a protective and aesthetically pleasing covering to the sides of the structure 10.

Referring again to FIG. 1, a ceiling (not shown) is formed within the structure 10, adjacent the upper portions of the exterior walls 12*a*-12*d*. The ceiling can include a ceiling covering (not shown) attached to ceiling joists 21*a*-21*g*. The ceiling covering can be made from any desired materials, including the non-limiting examples of ceiling tile or drywall. An interior space or attic 18 can be formed between the ceiling and the roof decks 14*a*, 14*b*.

Referring again to FIG. 1, the roof decks 14*a*, 14*b* include a plurality of truss chords 20*a*-20*g* configured to support other structures, such as for example, a plurality of sheathing panels 24 and shingles (not shown). In the embodiment illustrated in FIG. 1, the truss chords 20*a*-20*g* are spaced apart on 24.0 inch centers. However, in other embodiments, the truss chords 20*a*-20*g* can be spaced apart by other distances. Each of the truss chords 20*a*-20*g* has a length L1. In one exemplary embodiment, the attic 18 is an unvented attic. In one exemplary embodiment, the roof decks 14*a*, 14*b* of an unvented attic 18 are air sealed. This air sealing can be accomplished in a wide variety of different ways. For example, the shingles and/or the sheathing panels 24 are sealed to provide an air sealed roof deck. In another exemplary embodiment, a film, an underlayment or another material is placed on top of or below the sheathing panels to provide an air sealed roof deck.

A first gable 26*a* is formed between the roof decks 14*a*, 14*b* and the exterior wall 12*c*. Similarly, a second gable 26*b* is formed between the roof decks 14*a*, 14*b* and the exterior wall 12*d*.

As will be explained in more detail below, a boxed netting insulation system (hereafter "system") can be installed in the attic 18 in a position adjacent to the roof decks 14*a*, 14*b* such as to provide an insulation layer having a substantially uniform thickness, at an adjustable insulation depth and that insulates the truss chords 20*a*-20*g* forming the roof decks 14*a*, 14*b*.

Figure 2A:
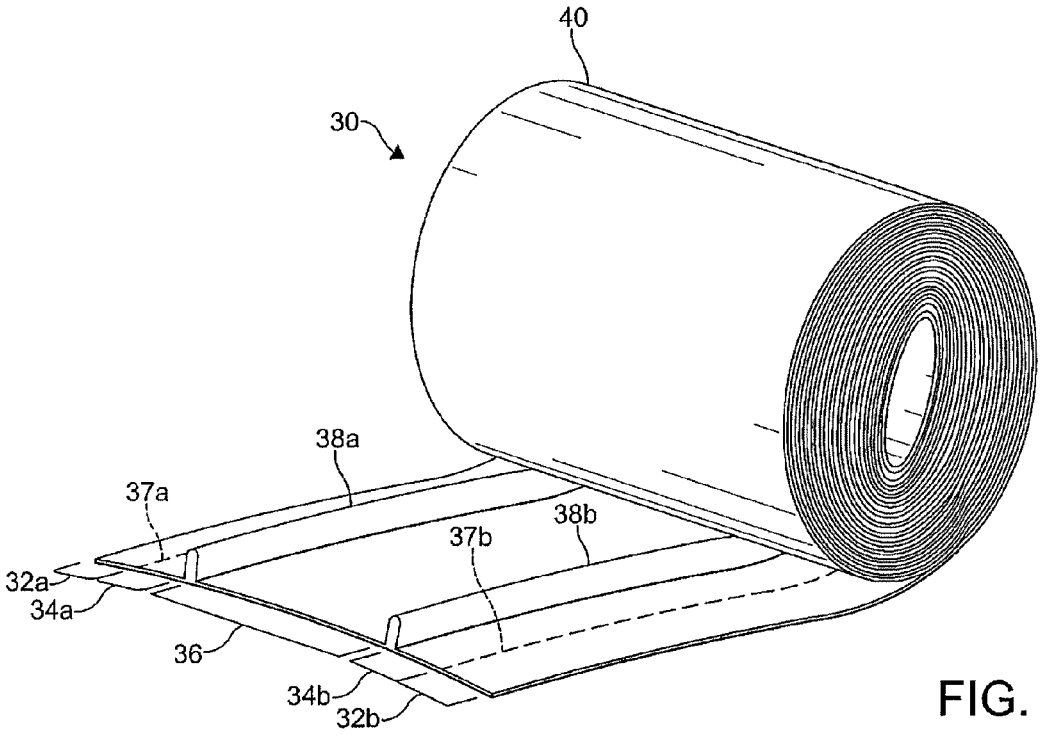
FIG. 2*a* is a perspective view of one embodiment of a netting for use between the adjacent truss chords of FIG. 1.
Figure 2B:
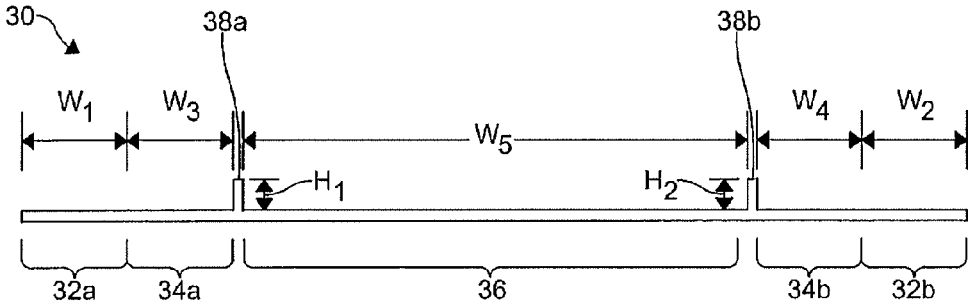
FIG. 2*b* is a front view, in elevation, of the netting of FIG. 2*a*.

Referring now to FIGS. 2*a* and 2*b*, a first embodiment of a netting 30 is illustrated. As will be explained below in more detail, the netting 30 is configured for attachment to the truss chords 20*a*-20*g* and further configured to contain the loosefill insulation material in a layer having a substantially uniform thickness.

The netting 30 includes end portions 32*a*, 32*b*, side panels 34*a*, 34*b* and a span segment 36. The end portions 32*a*, 32*b* are configured for attachment to a minor face of the truss chords 20*a*-20*g*. In the embodiment illustrated in FIG. 2*a*, the end portions 32*a*, 32*b* are defined by indicia 37*a*, 37*b* printed on a major face of the netting 30. However, it should be appreciated that the indicia 37*a*, 37*b* is optional and the boxed netting insulation system can be practiced without the indicia 37*a*, 37*b*.

The end portions 32*a*, 32*b* have widths W1, W2, respectively, that generally correspond to the widths of the minor faces of the truss chords 20*a*-20*g*. In the illustrated embodiment, the widths W1, W2 are in a range of from about 1.0 inches to about 2.0 inches. In other embodiments, the widths W1, W2 can be less than about 1.0 inches or more than about 2.0 inches. Optional, the end portions 32*a*, 32*b* can be reinforced with any desired reinforcing material, such as for example, fiberglass tape.

Referring again to FIGS. 2*a* and 2*b*, the side panels 34*a*, 34*b* have widths W3 and W4 respectively. As will be explained in more detail below, the side panels 34*a*, 34*b* are configured to hang from adjacent truss chords, and when coupled with the depth of the truss chords, form a desired insulation depth. In the illustrated embodiment, the widths W3, W4 are in a range of from about 2.0 inches to about 14.0 inches. In other embodiments, the widths W3, W4 can be less than about 2.0 inches or more than about 14.0 inches.

Referring again to FIGS. 2*a* and 2*b*, the span segment 36 is configured to extend from one truss chord to an adjacent truss chord and has a width W5. In the illustrated embodiment, the width W5 is in a range of from about 14.0 inches to about 30.0 inches. In other embodiments, the width W5 can be less than about 14.0 inches or more than about 30.0 inches, consistent with the distance from one truss chord to an adjacent truss chord.

Referring again to FIGS. 2*a* and 2*b*, the netting 30 has at least two tabs 38*a*, 38*b* extending from a major face. As will be explained in more detail below, the tabs 38*a*, 38*b* are configured for connection to the tabs of adjacent nettings. In the illustrated embodiment, the tabs 38*a*, 38*b* are formed by folded portions of the netting. However, the tabs 38*a*, 38*b* can be formed by other desired methods, such as for example, gathering and pinching portions of the nettings. Still further, it is within the contemplation of this invention that the tabs 38*a*, 38*b* can be separate and distinct components that are fastened to the netting 30.

In the embodiment shown in FIG. 2*a*, the tabs 38*a*, 38*b* extend continuously along any length of the netting 30 that may cut from a roll 40. However, in other embodiments, the tabs 38*a*, 38*b* can form discontinuous lengths sufficient to allow the tabs of netting positioned adjacent to each other to be connected together.

The tabs 38*a*, 38*b* have heights H1, H2 respectively. The heights H1, H2 are configured to allow the tabs of adjacent nettings to connect to each other. In the illustrated embodiment, the heights H1, H2 are in a range of from about 0.50 inches to about 4.0 inches. In other embodiments, the heights H1, H2 can be less than about 0.50 inches or more than about 4.0 inches, sufficient to allow the tabs of adjacent nettings to be connected together. While the tabs 38*a*, 38*b* are illustrated as having substantially the same height, it is contemplated that the tabs 38*a*, 38*b* can have different heights.

In the embodiment illustrated in FIGS. 2*a* and 2*b*, the netting 30 is formed from a nonwoven polymeric-based material, such as for example spunbonded polyester. In other embodiments, the netting 30 can be formed from other desired materials, such as the non-limiting examples of knitted or woven fabrics and materials formed from natural, synthetic or blended fibers.

The netting 30 has a basis weight. The term "basis weight", as used herein, is defined to mean a weight per square area. The basis weight of the netting 30 is configured to support the weight and compression of the loosefill insulation material within the insulation cavity. Accordingly, the basis weight of the netting 30 can vary as the depth of the insulation cavity varies. The basis weight of the netting can further vary as different fastening methods are used to connect the netting to the truss chords. In the illustrated embodiment, the netting 30 has a basis weight in a range from about 30 grams/square meter ($gm/m^2$) to about 70 $gm/m^2$. However, in other embodiments, the netting 30 can have a basis weight less than about 30 $gm/m^2$ or more than about 70 $gm/m^2$, such that the netting 30 can be attached to the truss chords 20*a*-20*g* and the netting 30 can contain the loosefill insulation material in a layer having a substantially uniform thickness.

Referring again to the embodiment shown in FIG. 2*a*, the netting 30 is provided on a roll 40. However, the netting 30 can be provided in other forms, such as the non-limiting example of folded sheets.

Figure 3:
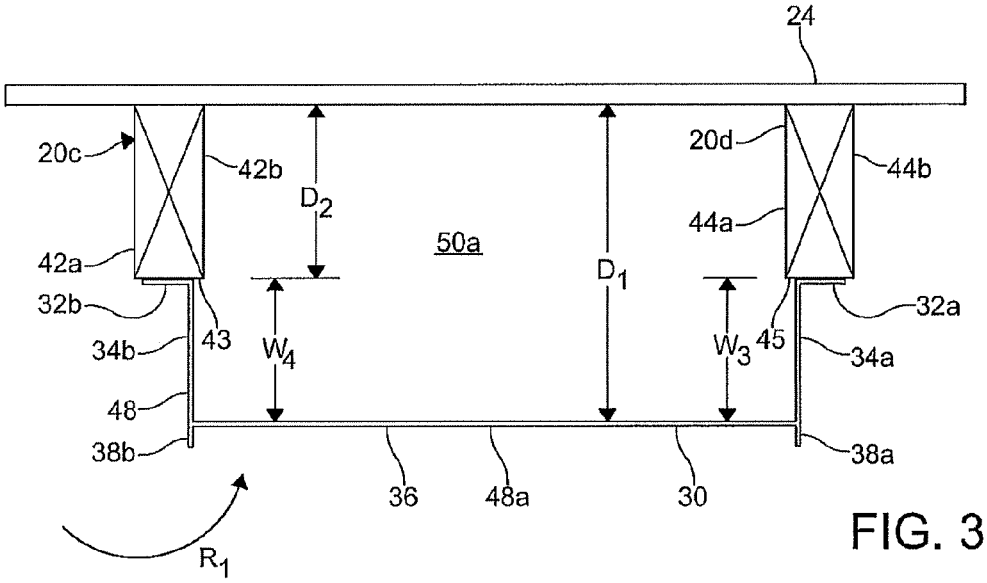
FIG. 3 is a partial front view, in elevation, of the building structure of FIG. 1 illustrating a first embodiment of a boxed netting insulation system.

Referring now to FIGS. 3-6, installation of the system is illustrated and described below. Referring first to FIG. 3, representative adjacent truss chords 20*c* and 20*d* and sheathing panel 24 are illustrated. Truss chord 20*c* has a first major face 42*a*, a second major face 42*b* and a first minor face 43. Similarly, truss chord 20*d* has a first major face 44*a*, a second major face 44*b* and a first minor face 45. In a first step, the netting 30 is unrolled from the roll 40 shown in FIG. 2*a* to expose a length of netting 30 that generally corresponds to the length L1 of the adjacent truss chords 20*c* and 20*d*. The netting 30 is cut thereby forming a formed length of netting 48*a*.

In a next step, the formed length of netting 48*a* is positioned along the length L1 of the adjacent truss chords 20*c*, 20*d* such that the tabs 38*a*, 38*b* extend in a direction away from the sheathing panel 24. Next, the end segment 32*b* is fastened to the first minor face 43 of truss chord 20*c* along the length L1 of the truss chord 20*c*, thereby allowing the formed length of netting 48 to hang from the first minor face 43 of truss chord 20*c*. While the embodiment illustrated in FIGS. 3-6 shows fastening of the end segment 32*b* to the first minor face 43 of truss chord 20*c*, it should be appreciated that in other embodiments, the end segment 32*b* can be fastened to other portions of the truss chord 20*c*, such as the non-limiting examples of a major face 42*a*, 42*b* or at the intersections of the first minor face 43 and the major faces 42*a*, 42*b*. In the illustrated embodiment, the end segment 32*b* is fastened to the first minor face 43 of the truss chord 20*c* with staples (not shown). In other embodiments, other desired fasteners can be used, such as the non-limiting examples of double sided tape, adhesives, clips or clamps.

Referring again to FIG. 3, in a next step, the span segment 36, side panel 34*a* and end portion 32*a* are rotated in a counter-clockwise direction, as indicated by direction arrow R1, toward the truss chord 20*d*. Next, the end segment 32*a* is fastened to the first minor face 45 of truss chord 20*d* along the length L1 of truss chord 20*d*, thereby allowing the side panels 34*a*, 34*b* and span segment 36 to hang from the truss chords 20*c*, 20*d*. In this position, the side panels 34*a*, 34*b*, span segment 36, truss chords 20*c*, 20*d* and the sheathing panel 24 cooperate to define a first insulation cavity 50*a*.

The first insulation cavity 50*a* extends the length L1 of the truss chords 20*c*, 20*d* and has a depth D1. The depth D1 of the first insulation cavity 50*a* is defined as the total of the depth D2 of the truss chords 20*c*, 20*d* and the widths W3, W4 of the side panels 34*a*, 34*b*. The depth D1 will be discussed in more detail below.

Figure 4:
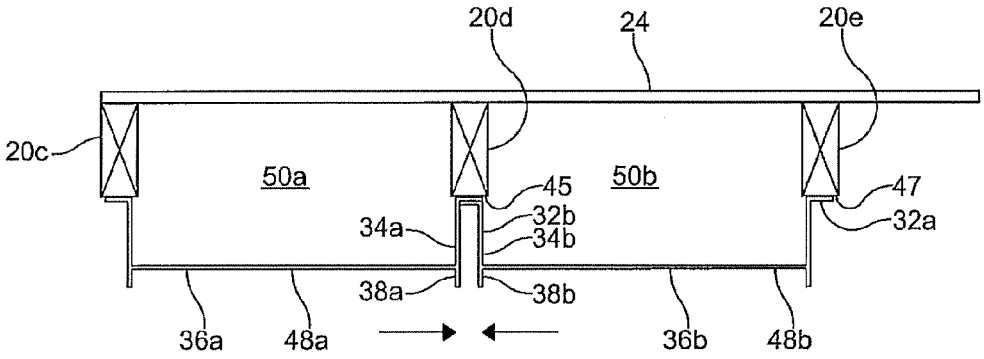
FIG. 4 is a partial front view, in elevation, of the building structure of FIG. 1 illustrating the first embodiment of a boxed netting insulation system.

Referring now to FIG. 4, netting 48*a* is shown attached to truss chords 20*c*, 20*d*. In a manner similar, end portion 32*b* of netting 48*b* is attached to the first minor face 45 of truss chord 20*d* and end portion 32*a* of netting 48*b* is attached to the first minor face 47 of truss chord 20*e*, thereby allowing the netting 48*b* to hang from the truss chords 20*d*, 20*e*. In this position, the netting 48*b*, truss chords 20*d*, 20*e* and the sheathing panel 24 define a second insulation cavity 50*b*.

Figure 5:
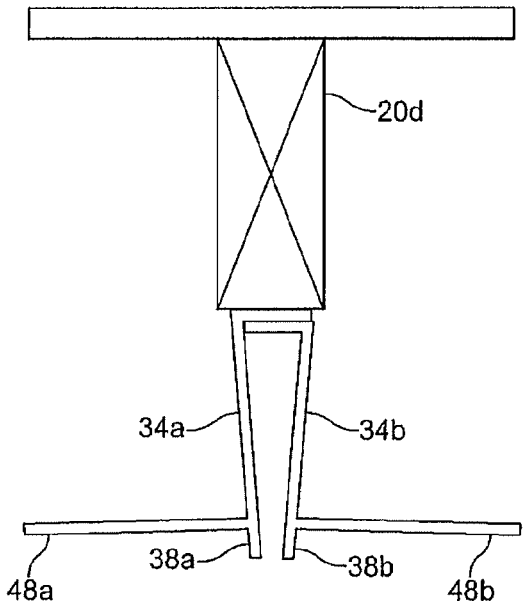
FIG. 5 in an enlarged partial front view, in elevation, of adjacent nettings of the boxed netting insulation system of FIG. 4.

Referring now to FIGS. 4 and 5, the tab 38*a* of netting 48*a* and the tab 38*b* of netting 48*b* hang such as to be substantially adjacent to each other. In a next step, the tabs 38*a*, 38*b* are fastened together along the length L1 of the truss chord 20*d*. Fastening of the tabs 38*a*, 38*b* brings portions of the side panel 34*a* of netting 48*a* and portions of the side panel 34*b* of netting 48*b* substantially together, and imparts a tension of the span segments 36*a*, 36*b* of the nettings 48*a*, 48*b*. The tension imparted on the span segments 36*a*, 36*b* results in the side panels 34*a*, 34*b* and the span segments 36*a*, 36*b* of the respective insulation cavities 50*a*, 50*b* forming boxlike cross-sectional shapes that are substantially retained after loosefill insulation is blown into the insulation cavities 50*a*, 50*b*. In the illustrated embodiment, the tabs 38*a*, 38*b* are fastened together at intervals in a range of about 2.0 inches to about 8.0 inches. In other embodiments, the tabs 38*a*, 38*b* can be fastened together at intervals less than about 2.0 inches or more than about 8.0 inches.

Referring again to FIGS. 4 and 5, the tabs 38*a*, 38*b* have been fastened together using a plurality of fasteners (not shown). In the illustrated embodiment, the fasteners are staples. However, in other embodiments, the tabs 38*a*, 38*b* can be fastened together using other structures and devices, such as the non-limiting examples of adhesives, clips and clamps.

Figure 6:
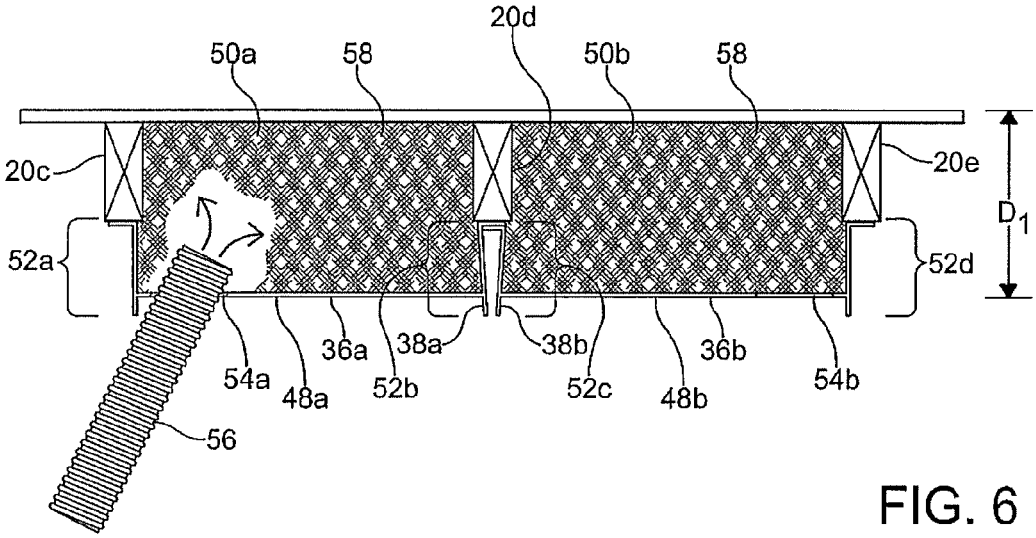
FIG. 6 is a partial front view, in elevation, of the building structure of FIG. 1 illustrating distribution of loosefill insulation material within insulation cavities formed by the boxed netting insulation system of FIG. 4.

Referring now to FIG. 6, the nettings 48*a*, 48*b* are shown after the tabs 38*a*, 38*b* have been fastened together and a tension has been established in the span segments 36*a*, 36*b*, thereby forming the box-like cross-sectional shapes of the insulation cavities 50*a*, and 50*b*. As further shown in FIG. 6, a first insulation pocket 52*a* is formed as a portion of insulation cavity 50*a* and is located under truss chord 20*c*. A second insulation pocket 52*b* is formed as a portion of insulation cavity 50*a* and is located under truss chord 20*d*. A third insulation pocket 52*c* is formed as a portion of insulation cavity 50*b* and is located under truss chord 20*d* and a fourth insulation pocket 52*d* is formed as a portion of insulation cavity 50*b* and is located under truss chord 20*e*. The insulation pockets 52*a*-52*d* will be discussed in more detail below.

Referring again to FIG. 6 in a next step, opening 54*a* is formed in the span segment 36*a* such as to allow insertion of a distribution hose 56 into the insulation cavity 50*a*. The distribution hose 56 is attached to a blowing insulation machine (not shown) and configured to convey conditioned loosefill insulation material 58 from the blowing insulation machine to the insulation cavity 50*a*. Any desired distribution hose 56 and blowing insulation machine can be used sufficient to convey conditioned loosefill insulation material 58 from the blowing insulation machine to the insulation cavity 50*a*. Distribution of the loosefill insulation material 58 into the insulation cavity 50*a* continues until the insulation cavity 50*a* is filled. An opening 54*b* is formed in the span segment 36*b* and the insulation cavity 50*b* is filled in a similar manner. In the illustrated embodiment, a single opening 54*a* is used to fill an insulation cavity. However, it should be appreciated that more than one opening can be used to fill an insulation cavity.

Referring again to FIG. 6, the loosefill insulation material 58 can be any desired loosefill insulation material, such as a multiplicity of discrete, individual tuffs, cubes, flakes, or nodules. The loosefill insulation material 58 can be made of glass fibers or other mineral fibers, and can also be polymeric fibers, organic fibers or cellulose fibers. The loosefill insulation material 58 can have a binder material applied to it, or it can be binderless.

Referring again to FIG. 6 in a final step, the openings 54*a*, 54*b* are covered with coverings (not shown) sufficient to prevent loosefill insulation material within the insulation cavities 50*a*, 50*b* from falling out of the openings 54*a*, 54*b*. In the illustrated embodiment, the coverings are formed from an adhesive tape. However, the coverings can be formed from other desired structures or materials. The steps of forming the box-shaped insulation cavities between adjacent truss chords and filling the insulation cavities with loosefill insulation material are repeated until all of the insulation cavities between truss chords forming a roof deck are completed. While the embodiment shown in FIG. 6 has been described above as covering the openings 54*a*, 54*b* with coverings in the form of adhesive tape, in other embodiments the openings 54*a*, 54*b* can be plugged with compressible or conformable materials. One non-limiting example of a compressible or conformable material is a portion of a batt of fiberglass insulation.

The boxed netting insulation system advantageously provides many benefits, although not all benefits may be realized in all circumstances. First, as shown in FIG. 6, the box-shaped insulation cavities, 50*a*, 50*b* provide a uniform thickness of the loosefill insulation material. The term "uniform thickness", as used herein, is defined to mean having a substantially consistent depth. The uniform thickness of the loosefill insulation material is substantially maintained by the tension formed in the span segments after the loosefill insulation cavities are filled with the loosefill insulation material.

Second, the depth D1 of the insulation cavities can be adjusted to provide different depths of the loosefill insulation material. Referring to FIG. 3 as discussed above, the depth of the loosefill insulation material is the sum of the depth D2 of the truss chords 20*c*, 20*d* and the width W3, W4 of the side panels 34*a*, 34*b*. Accordingly, differing the widths W3, W4 of the side panels 34*a*, 34*b* provides differing depths D1 of the insulation cavity. As the thermal resistance (R-Value) of the loosefill insulation material within the insulation cavities is, in part, a function of the depth of the loosefill insulation material, the thermal resistance (R-Value) of the loosefill insulation material can be adjusted by differing widths W3, W4 of the side panels 34*a*, 34*b*.

In the illustrated embodiment, varying the widths W3, W4 of the side panels 34*a*, 34*b* results in different R-values of the resulting layer of loosefill insulation material within the insulation cavities as shown in Table 1.

TABLE 1

| Side Panel Width (Inches) | Truss Chord Depth (Inches) | Insulation Cavity Depth (Inches) | Insulation Material Density (Lbs/Ft$^3$) | Thermal Resistance (R-value) (Btu-In/(Hr · Ft$^2$ · ° F.)) |
|---|---|---|---|---|
| 2.00 | 3.50 | 5.50 | 1.30 | R-22 |
| 4.00 | 3.50 | 7.50 | 1.30 | R-30 |
| 6.00 | 3.50 | 9.50 | 1.30 | R-38 |
| 8.75 | 3.50 | 12.25 | 1.30 | R-49 |

As shown in Table 1, the thermal resistance (R-value) of the layer of a particular brand of loosefill insulation material can be varied by varying the width of the side panels. As one specific example, a thermal resistance (R-Value) of 22 can be achieved with an insulation cavity depth of 5.50 inches. While the specific example discussed above is based on a side panel width W3 of 2.00 inches and a truss chord depth D2 of 3.50 inches, it should be noted that Table 1 advantageously includes other values of thermal resistance (R-Value) for other side panel widths. It should also be appreciated that the results shown in Table 1 would be different for Truss Chord Depths of more or less than 3.50 inches and for Insulation Material Densities of more or less than about 1.30 lbs/ft$^3$.

Referring again to FIG. 6 for a third advantage, distributing the loosefill insulation material 58 into the insulation cavities 50*a*, 50*b* results in loosefill insulation material filling the insulation pockets 52*a*-52*d*. As the filled insulation pockets 52*a*-52*d* are positioned below the truss chords 20*c*, 20*d* and 20*e*, the filled insulation pockets 52*a*-52*d* are configured to insulate the truss chords 20*c*, 20*d* and 20*e*.

While the embodiment of the boxed netting insulation system shown in FIGS. 3-6 and described above illustrates one method of forming boxed insulation cavities, it should be appreciated that the netting can be configured to form boxed insulation cavities by other methods. Referring now to FIGS. 7*a*-7*g*, another method of forming boxed insulation cavities is illustrated. Generally, this method entails use of a clamp having a clam-shell configuration to secure the netting to adjacent truss chords. The clamp is further configured to shape the netting in the form of a box, thereby forming the boxed insulation cavities.

Figure 7A:
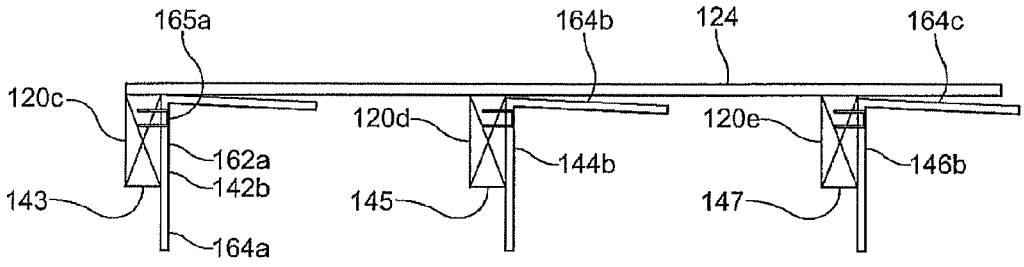
FIG. 7*a* is a partial front view, in elevation, of the building structure of FIG. 1 illustrating initial installation of clamps for a second embodiment of a boxed netting insulation system.

Referring first to FIG. 7*a*, truss chords 120*c*, 120*d*, and 120*e* and sheathing panel 124 are illustrated. In the illustrated embodiment, truss chords 120*c*, 120*d*, 120*e* and sheathing panel 124 are the same as, or similar to, truss chords 20*c*, 20*d*, 20*e* and sheathing panel 24 shown in FIG. 6 and described above. However, in other embodiments, truss chords 120*c*, 120*d*, 120*e* and sheathing panel 124 can be different from truss chords 20*c*, 20*d*, 20*e* and sheathing panel 24. Truss chord 120*c* has a major face 142*b* and a minor face 143. Similarly, truss chord 120*d* has a major face 144*b* and a minor face 145, and truss chord 120*e* has a major face 146*b* and a minor face 147.

Referring again to FIG. 7*a*, a first leg 162*a* of a first clamp 164*a* is fastened to the major face 142*b* of the truss chord 120*c* with one or more fasteners 165*a*. In the illustrated embodiment, the fastener 165*a* is a staple. However, the fastener 165*a* can be other mechanisms, devices or structures, such as for example clips, clamps or adhesives sufficient to fasten the first clamp 164*a* to the truss chord 120*c*. In a similar manner, second and third clamps 164*b*, 164*c* are fastened to truss chords 120*d*, 120*e*.

In the embodiment shown in FIG. 7*a*, the clamps 164*a*-164*c* are formed from structural cardboard material. In other embodiments, the clamps 164*a*-164*c* can be formed from other desired materials, such as the non-limiting example of fabric or fiberglass scrim, sufficient to form a clam-shell configuration to secure the netting to the truss chords.

Figure 7B:
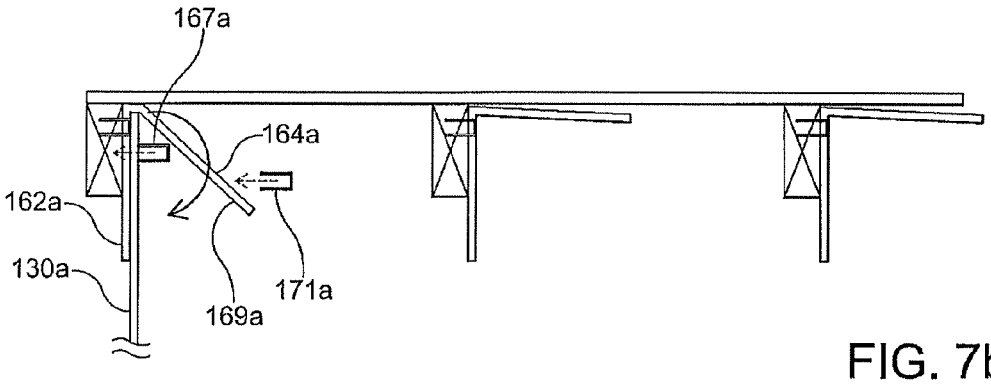
FIG. 7*b* is a partial front view, in elevation, of the building structure of FIG. 1 illustrating initial installation of a first netting for the second embodiment of a boxed netting insulation system.

Referring now to FIG. 7*b*, a first netting 130*a* is positioned adjacent to the first leg 162*a* of the first clamp 164*a* and fastened to the truss chord 120*c* with one or more fasteners 167*a*. After the first netting 130*a* is fastened to the truss chord 120*c*, a second leg 169*a* of the first clamp 164*a* is rotated such as to be positioned adjacent to the first netting 130*a* and fastened to the truss chord 120*c* with one or more fasteners 171*a*. In the illustrated embodiment, the fasteners 167*a*, 171*a* are the same as, or similar to the fastener 165*a*, However, in other embodiments, the fasteners 167*a*, 171*a* can be different from the fastener 165*a*.

Figure 7C:
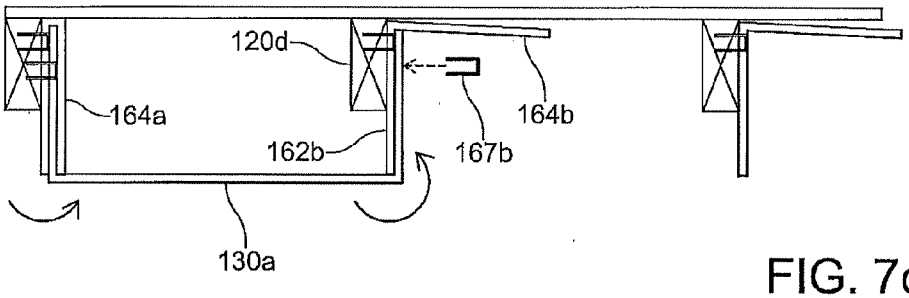
FIG. 7*c* is a partial front view, in elevation, of the building structure of FIG. 1 illustrating completion of the first netting installation for the second embodiment of a boxed netting insulation system.

Referring now to FIG. 7*c*, the portion of the first netting 130*a* extending from the first clamp 164*a* is rotated in a counter-clockwise direction such that a portion of the first netting 130*a* is positioned adjacent to a first leg 162*b* of the second clamp 164*b*. The first netting 130*a* is fastened to the truss chord 120*d* by fastener 167*b* as discussed above. Fastening of the first netting 130*a* to the first leg 162*b* of the second clamp 164*b* imparts a tension on first netting 130*a*. The tension imparted on the first netting 130*a* will be discussed in more detail below.

Figure 7D:
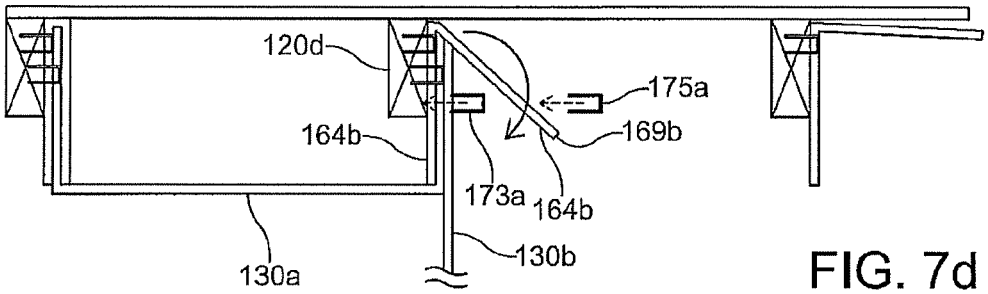
FIG. 7*d* is a partial front view, in elevation, of the building structure of FIG. 1 illustrating initial installation of a second netting for the second embodiment of a boxed netting insulation system.

Referring now to FIG. 7*d*, once the first netting 130*a* is fastened to the truss chord 120*d*, a second netting 130*b* is positioned adjacent to the first netting 130*a* and fastened to the truss chord 120*d* with one or more fasteners 173*a*. After the second netting 130*b* is fastened to the truss chord 120*d*, a second leg 169*b* of the second clamp 164*b* is rotated such as to be positioned adjacent to the second netting 130*b* and the second leg 169*b* fastened to the truss chord 120*d* with one or more fasteners 175*a*.

Figure 7E:
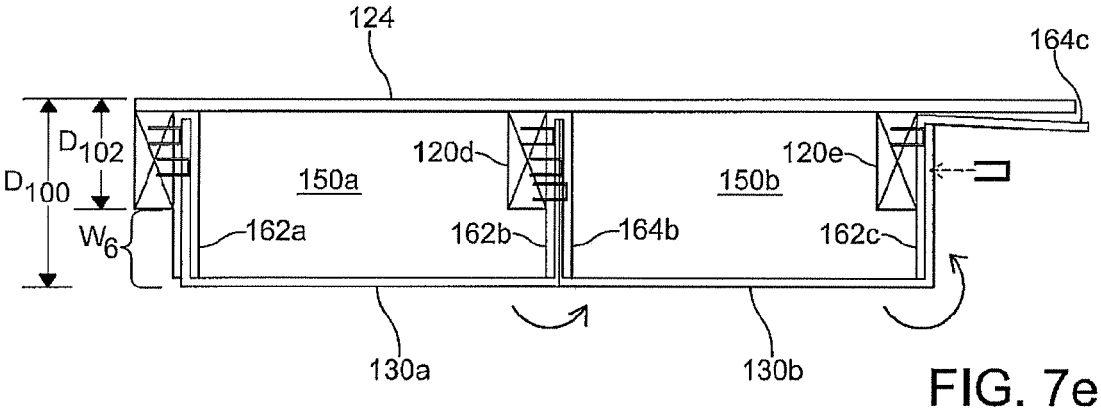
FIG. 7*e* is a partial front view, in elevation, of the building structure of FIG. 1 illustrating completion of the second netting installation for the second embodiment of a boxed netting insulation system.

Referring now to FIG. 7*e*, the portion of the second netting 130*b* extending from the second clamp 164*b* is rotated in a counter-clockwise direction such that a portion of the second netting 130*b* is positioned adjacent to a first leg 162*c* of the third clamp 164*c*. The second netting 130*b* is fastened to the truss chord 120*e* as discussed above. In a repetitive manner, nettings and clamps are installed on the desired truss chords.

Referring again to FIG. 7*e*, the first clamp 162*a*, first netting 130*a*, truss chord 120*d*, second clamp 162*b* and sheathing panel 124 define a first insulation cavity 150*a*. Similarly, the second clamp 162*b*, second netting 130*b*, truss chord 120*e*, third clamp 162*c* and sheathing material 124 define a second insulation cavity 150*b*. As discussed above, a tension is imparted on the nettings 130*a*, 130*b*. Accordingly, the tensions result in the insulation cavities 150*a*, 150*b* having boxlike cross-sectional shapes that are substantially retained after loosefill insulation is blown into the insulation cavities 150*a*, 150*b*.

Figure 7F:
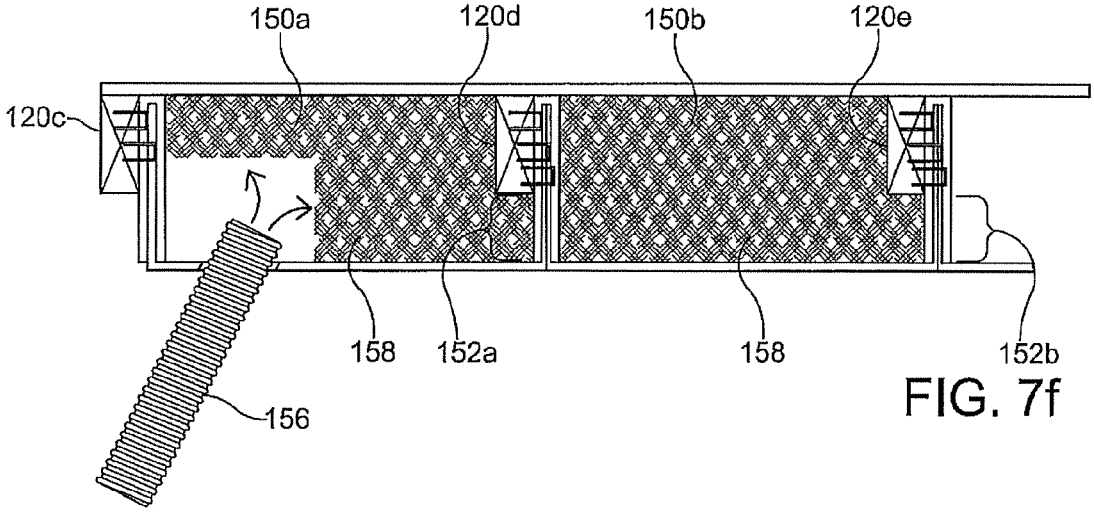
FIG. 7*f* is a partial front view, in elevation, of the building structure of FIG. 1 illustrating distribution of loosefill insulation material within insulation cavities formed by the boxed netting insulation system of FIG. 7*e*.

Referring now to FIG. 7*f*, loosefill insulation 150 is distributed within the insulation cavities 150*a*, 150*b* by a distribution hose 156 and a blowing insulation machine (not shown) as discussed above.

Referring again to FIG. 7*e*, the insulation cavities 150*a*, 150*b* has a depth D100. The depth D100 is defined as the total of the depth D102 of the truss chords 120*c*-120*e* and the width W6 of portions of the clamps 164*a*-164*c* that extend below the truss chords. The width W6 is adjustable such as to result in different depths D100 of the insulation cavity.

Referring again to FIG. 7*f*, a first insulation pocket 152*a* is formed as a portion of insulation cavity 150*a* and is located under truss chord 120*d*. A second insulation pocket 152*b* is famed as a portion of insulation cavity 150*b* and is located under truss chord 120*e*. Distributing loosefill insulation material 158 into the insulation cavities 150*a*, 150*b* results in loosefill insulation material filling the insulation pockets 152*a*, 152*b*. As the filled insulation pockets 152*a*, 152*b* are positioned below the truss chords 120*d*, 120*e*, the filled insulation pockets 152*a*, 152*b* are configured to insulate the truss chords 120*d*, 120*e*.

Referring again to FIGS. 7*a*-7*f*, the boxed netting insulation system provides the same advantages as previously discussed, namely, a uniform thickness of the loosefill insulation material, the depth of the insulation cavities can be adjusted to provide different depths of the loosefill insulation material and insulation pockets positioned below the truss chords are filled with loosefill insulation material, thereby insulating the truss chords.

Referring now to FIGS. 8*a*-8*d*, another method of forming boxed insulation cavities is illustrated. Generally, this method entails use of fixture having shapes that defines a box-like perimeter over which nettings are positioned.

Figure 8A:
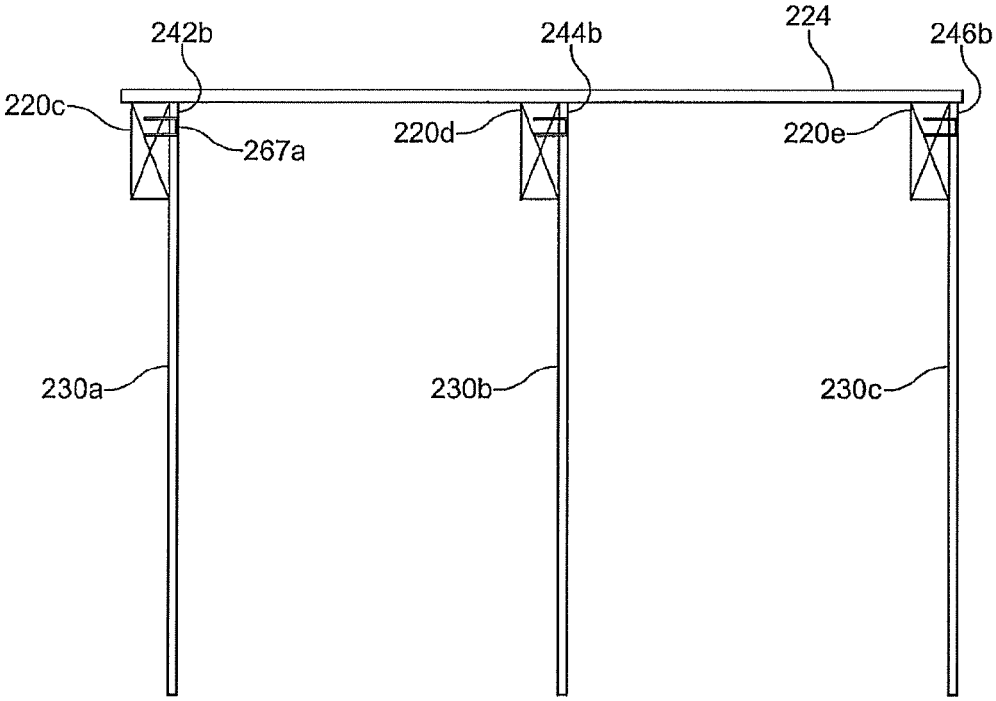
FIG. 8*a* is a partial front view, in elevation, of the building structure of FIG. 1 illustrating initial installation of nettings for a third embodiment of a boxed netting insulation system.

Referring first to FIG. 8*a*, truss chords 220*c*, 220*d*, and 220*e* and sheathing panel 224 are illustrated. In the illustrated embodiment, truss chords 220*c*, 220*d*, 220*e* and sheathing panel 224 are the same as, or similar to, truss chords 20*c*, 20*d*, 20*e* and sheathing panel 24 shown in FIG. 6 and described above. However, in other embodiments, truss chords 220*c*, 220*d*, 220*e* and sheathing panel 224 can be different from truss chords 20*c*, 20*d*, 20*e* and sheathing panel 24. Truss chord 220*c* has a major face 242*b*, truss chord 220*d* has a major face 244*b* and truss chord 220*e* has a major face 246*b*.

Referring again to FIG. 8*a*, a portion of a first netting 230*a* is positioned adjacent to the major face 242*b* of truss chord 220*c* and fastened to the truss chord 220*c* with one or more fasteners 267*a*. In a similar manner, portions of a second netting 230*b* and a third netting 230*c* are fastened to the truss chords 220*d*, 230*e* respectively.

Figure 8B:
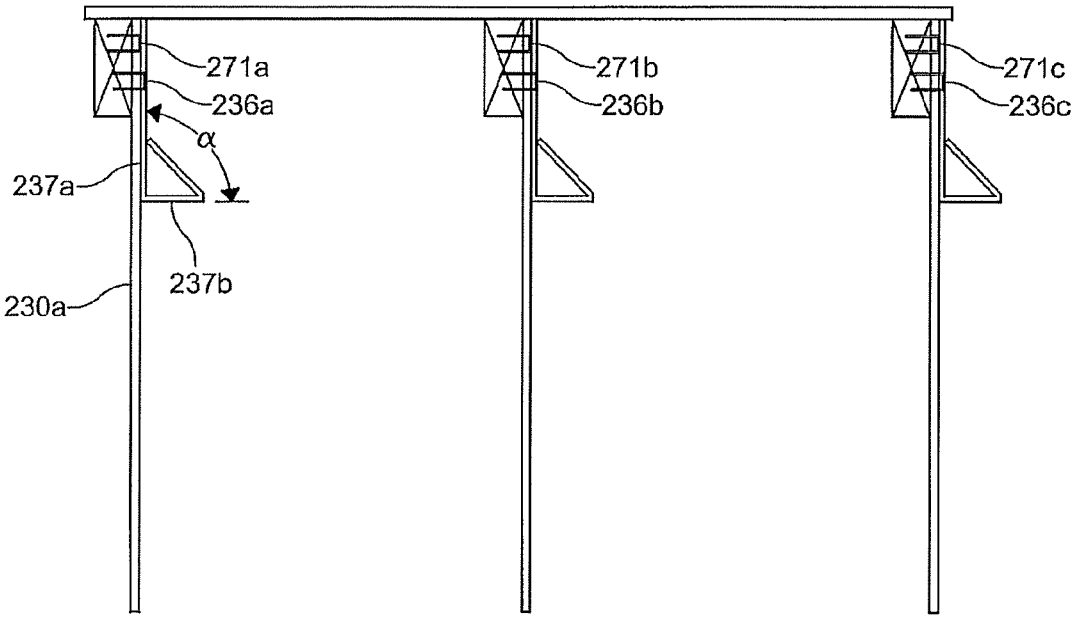
FIG. 8*b* is a partial front view, in elevation, of the building structure of FIG. 1 illustrating initial installation of fixtures for the third embodiment of a boxed netting insulation system.

Referring now to FIG. 8*b*, after the first netting 230*a* is fastened to the truss chord 220*c*, a fixture 236*a* is positioned adjacent to the first netting 230*a* and fastened to the truss chord 220*c* with one or more fasteners 271*a*. In a similar manner, fixtures 236*b* and 236*c* are fastened to truss chords 220*d* and 220*e* respectively.

Referring again to FIG. 8*b*, a portion of the fixture 236*a* has the cross-sectional shape of a right triangle incorporating a base angle and a base legs 237*a* and 237*b*. As will be discussed in more detail below, the base legs 237*a*, 237*b* and the base angle to provide a circumference around which the netting 230*a* is positioned, thereby forming a boxed insulation cavity. In the illustrated embodiment the base angle is approximately 90°. In other embodiments, the base angle a can be more or less than about 90°, sufficient to allow the netting 230*a* to form a box shape. While the embodiment shown in FIG. 8*b* illustrates a portion of the fixture 236*a* as having the cross-sectional shape of a right triangle, in other embodiments, the fixture can incorporate other geometric cross-sectional shapes, such as for example a simple "L" cross-sectional shape sufficient to allow the netting 230*a* to form a box shape.

Figure 8C:
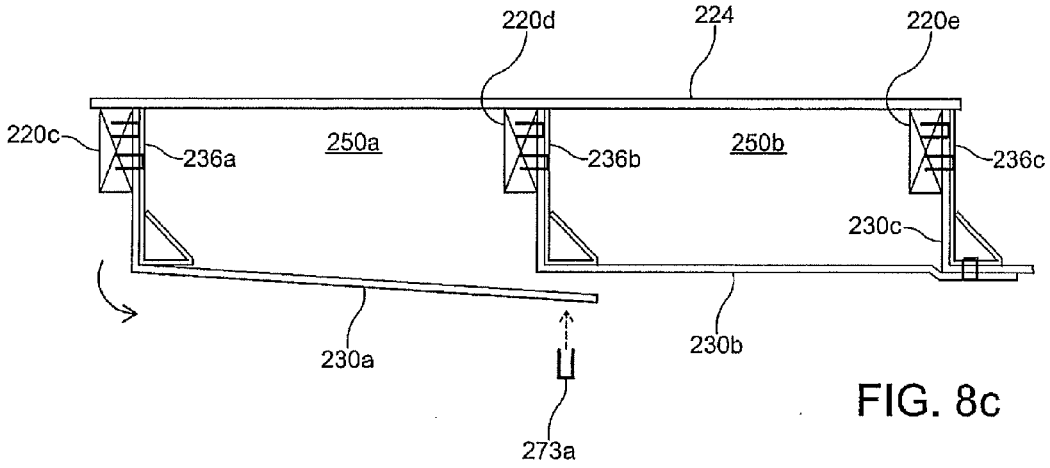
FIG. 8*c* is a partial front view, in elevation, of the building structure of FIG. 1 illustrating installation of nettings over the fixtures of FIG. 8*b* for the third embodiment of a boxed netting insulation system.

Referring now to FIG. 8*c*, the first netting 230*a* and fixture 236*a* and a second netting 230*b* and fixtures 236*b*, 236*e* are illustrated. The second netting 230*b* is shown wrapped around the triangular portion of the fixture 236*b* and attached to the triangular portion of the fixture 236*c*. In a next assembly step, the first netting 230*a* is wrapped around the triangular portion of the fixture 236*a* and positioned over the second netting 230*b*. Finally the first netting 230*a* is attached to the triangular portion of the fixture 236*b* with a fastener 273*a* as discussed above. In a repetitive manner, nettings and fixtures are installed on the desired truss chords.

In the embodiment shown in FIGS. 8*b* and 8*c*, the fixtures 236*a*-236*c* are formed from structural cardboard. In other embodiments, the fixtures 236*a*-236*c* can be formed from other materials, such as the non-limiting example of reinforced fiberglass or polymeric-based materials sufficient to allow a netting to be wrapped around the fixture and form a box-shaped insulation cavity.

Referring again to FIG. 8*c*, the first fixture 236*a*, first netting 230*a*, truss chord 220*d*, second netting 230*b* and sheathing panel 224 define a first insulation cavity 250*a*. Similarly, the second fixture 236*b*, second netting 230*b*, truss chord 220*e*, third netting 230*c* and sheathing panel 224 define a second insulation cavity 250*b*. Fastening of the first netting 230*a* to the fixtures 236*a*, 236*b* imparts a tension on first netting 230*a* and fastening of the second netting 230*b* to the fixtures 236*b*, 236*c* imparts a tension on the second netting 230*b*. As discussed above, the tension on the nettings 230*a*, 230*b* results in the insulation cavities 250*a*, 250*b* having box-like cross-sectional shapes that are substantially retained after loosefill insulation is blown into the insulation cavities 250*a*, 250*b*.

Figure 8D:
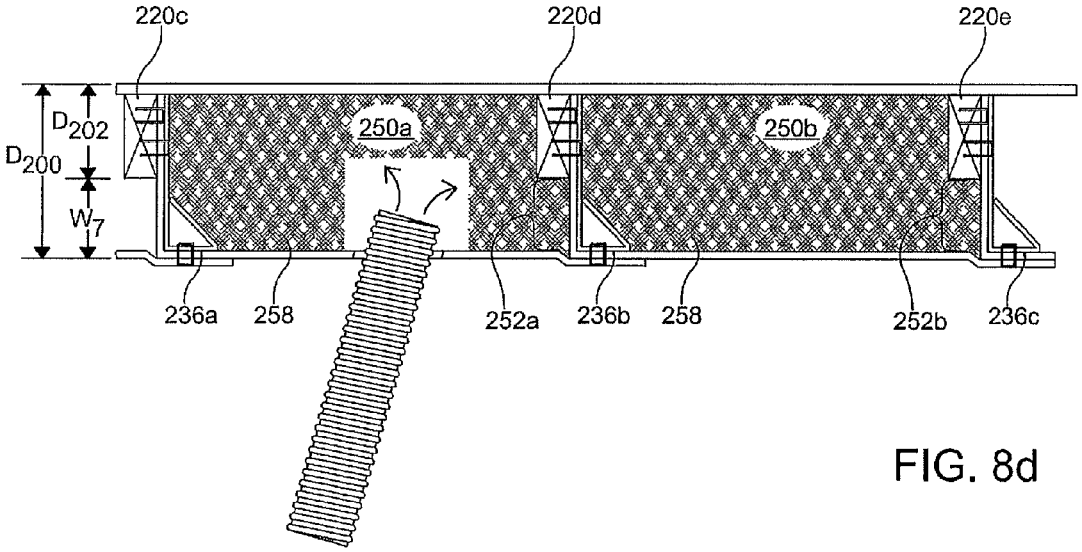
FIG. 8*d* is a partial front view, in elevation, of the building structure of FIG. 1 illustrating distribution of loosefill insulation material within insulation cavities formed by the boxed netting insulation system of FIG. 8*c*.

Referring now to FIG. 8*d*, loosefill insulation 258 is distributed within the insulation cavities 250*a*, 250*b* as discussed above.

Referring again to FIG. 8*d*, the insulation cavities 250*a*, 250*b* have a depth D200. The depth D200 of is defined as the total of the depth D202 of the truss chords 220*e*-220*e* and the width W7 of the fixtures that extend below the truss chords. The width W7 is adjustable such as to result in different depths D200 of the insulation cavity.

As further shown in FIG. 8*d*, a first insulation pocket 252*a* is formed as a portion of insulation cavity 250*a* under truss chord 220*d*. A second insulation pocket 252*b* is formed as a portion of insulation cavity 250*b* under truss chord 220*e*. Distributing loosefill insulation material 258 into the insulation cavities 250*a*, 250*b* results in loosefill insulation material filling the insulation pockets 252*a*, 252*b*. As the filled insulation pockets 252*a*, 252*b* are located below the truss chords 220*d*, 220*e*, the filled insulation pockets 252*a*, 252*b* are configured to insulate the truss chords 220*d*, 220*e*.

Referring again to FIG. 8*d*, optionally the triangular portion of the fixtures 236*a*-236*c* could include openings (not shown). The openings can be configured to allow the distributed loosefill insulation material into the interior of the triangular portion of the fixtures 236*a*-236*c* such that the loosefill insulation material fills the interior of the triangular portion of the fixtures 236*a*-236*c*. In this manner, the insulation cavities 250*a*, 250*b* maintain a substantially uniform thickness of loosefill insulation material.

Referring again to FIGS. 8*a*-8*d*, the boxed netting insulation system provides the same advantages as previously discussed, namely, a uniform thickness of the loosefill insulation material, the depth of the insulation cavities can be adjusted to provide different depths of the loosefill insulation material and insulation pockets positioned below the truss chords are filled with loosefill insulation material, thereby insulating the truss chords.

Figure 9A:
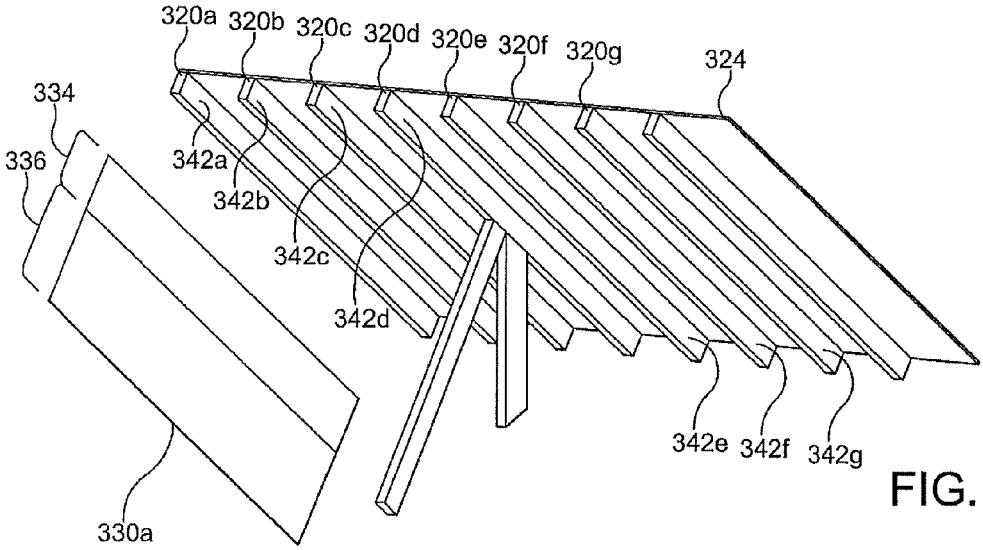
FIG. 9*a* is a partial perspective view, of the building structure of FIG. 1 illustrating initial installation of a rigid membrane for a fourth embodiment of a boxed netting insulation system.
Figure 9B:
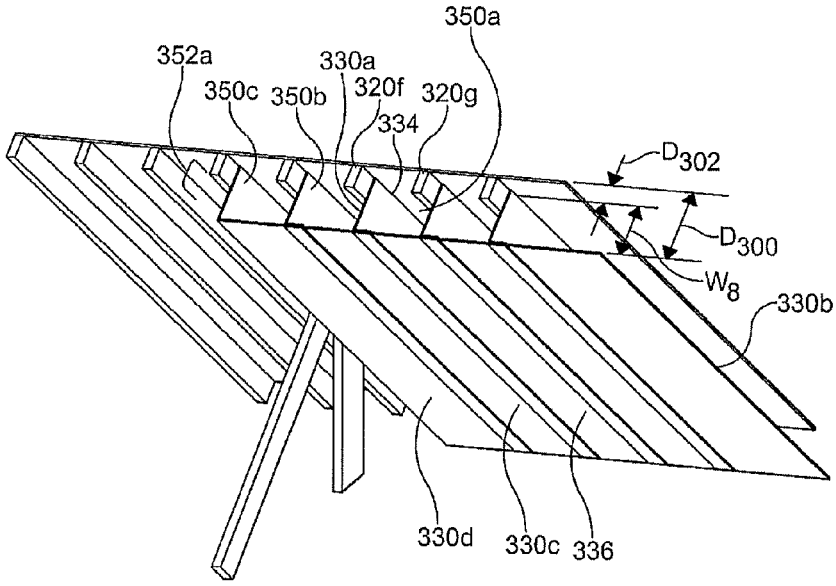
FIG. 9*b* is a partial perspective view, of the building structure of FIG. 1 illustrating insulation cavities formed from the rigid membranes of FIG. 9*a* for the fourth embodiment of a boxed netting insulation system.

Referring now to FIGS. 9*a*-9*b*, another method of forming boxed insulation cavities is illustrated. Generally, this method entails use of substantially rigid membranes as nettings. The rigid membranes are formed into shapes that subsequently define box-like insulation cavities in an installed position.

Referring first to FIG. 9*a*, truss chords 320*a*-320*g* and sheathing panel 324 are illustrated. In the illustrated embodiment, truss chords 320*a*-320*g* and sheathing panel 324 are the same as, or similar to, truss chords 20*c*, 20*d*, 20*e* and sheathing panel 24 shown in FIG. 6 and described above. However, in other embodiments, truss chords 320*a*-320*g* and sheathing panel 324 can be different from truss chords 20*c*, 20*d*, 20*e* and sheathing panel 24. Truss chords 320*a*-320*g* have major faces 342*a*-342*g* respectively.

Referring again to FIG. 9*a*, a rigid membrane 330*a* is illustrated. The rigid membrane 330*a* includes a side panel segment 334 and a span segment 336.

Referring now to FIG. 9*b*, the side panel segment 334 of rigid membrane 330*a* is positioned adjacent to the major face 342*f* of truss chord 320*f* and fastened to the truss chord 320*f* with one or more fasteners (not shown). The rigid membrane 330*a* is bent such that the side panel segment 334 and the span segment 336 form an approximate right angle with each other. The span segment 336 spans the distance between adjacent truss chords 320*f*, 320*g* and is subsequently fastened to a previously installed rigid membrane 330*b* with any desired fasteners (not shown). In a repetitive manner, additional rigid membranes 330*c*, 330*d* are installed on the desired truss chords.

As shown in FIG. 9*b*, the approximate right angles formed between the side panel segments and the span segments define box-shaped insulation cavities 350*a*-350*c*.

In the embodiment shown in FIGS. 9*a* and 9*b*, the rigid membranes are formed from a structural cardboard material. The structural cardboard material is configured to retain the box-like cross-sectional shape of the insulation cavity after the loosefill insulation material is distributed into the formed insulation cavities. In other embodiments, the rigid membranes can be formed from other materials, such as the non-limiting example of reinforced fiberglass or polymeric-based materials sufficient to form a box-shaped insulation cavity.

Referring again to FIG. 9*b*, the insulation cavities 350*a*-350*c* have a depth D300. The depth D300 is defined as the total of the depth D302 of the truss chords 320*a*-320*g* and the width W8 of the side panel segments 334 that extend below the truss chords. The width W8 is adjustable such as to result in different depths D300 of the insulation cavities.

As further shown in FIG. 9*b*, a first insulation pocket 352*a* is formed as a portion of insulation cavity 350*a* and is located under truss chord 320*g*. Similarly, other insulation pockets are formed as portions of the insulation cavities and are located under the truss chords. Distributing loosefill insulation material (not shown) into the insulation cavities results in loosefill insulation material filling the insulation pockets. As the filled insulation pockets are located below the truss chords, the filled insulation pockets are configured to insulate the truss chords.

Referring again to FIGS. 9*a*-9*b*, the boxed netting insulation system provides the same advantages as previously discussed, namely, a uniform thickness of the loosefill insulation material, the depth of the insulation cavities can be adjusted to provide different depths of the loosefill insulation material and insulation pockets located below the truss chords are filled with loosefill insulation material, thereby insulating the truss chords.

Figure 10A:
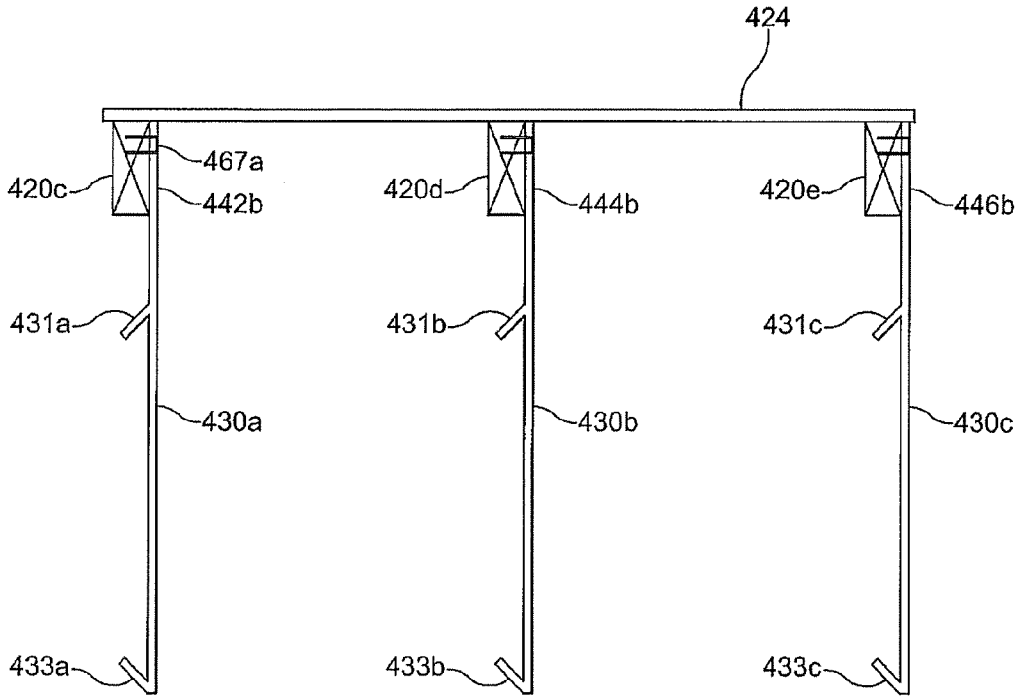
FIG. 10*a* is a partial front view, in elevation, of the building structure of FIG. 1 illustrating initial installation of rigid members for a fifth embodiment of a boxed netting insulation system.
Figure 10B:
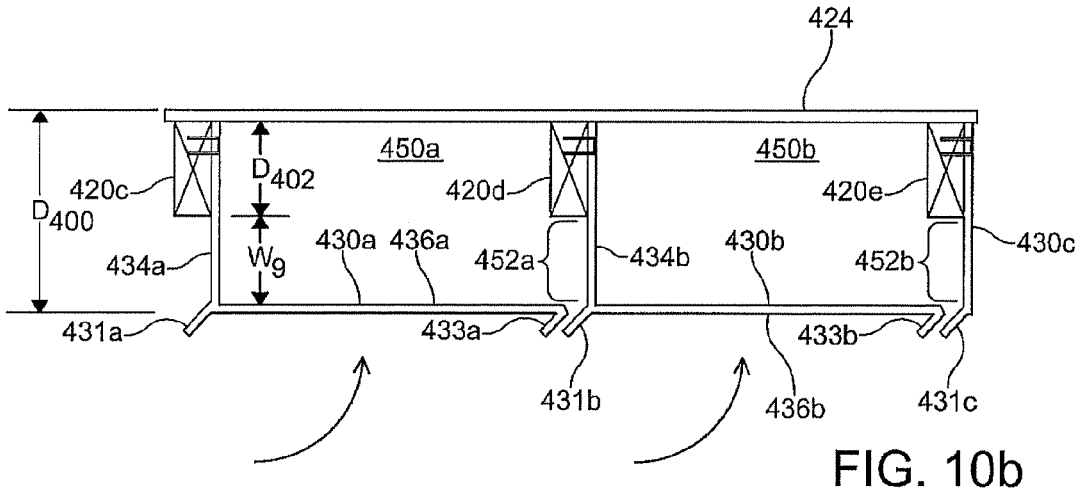
FIG. 10*b* is a partial front view, in elevation, of the building structure of FIG. 1 illustrating completed installation the rigid members of FIG. 10*a* for the fifth embodiment of a boxed netting insulation system.

Referring now to FIGS. 10*a*-10*b*, another method of forming boxed insulation cavities is illustrated. Generally, this method entails use of interconnecting, substantially rigid members and/or flexible material such as netting, for example, the netting 30 described in the embodiments illustrated by FIGS. 2*a*, 2*b* and 3-6 to form box-shaped insulation cavities. The interconnecting material may take a wide variety of different forms and may take a wide variety of different configurations. For example, rigid interconnecting material may comprise cardboard, plastic, and the like. The netting material 30 may comprise a plastic film, a mesh, and the like. In one exemplary embodiment, the netting material may be a breathable material, a vapor barrier, a vapor retarder, and/or an air barrier material.

Referring first to FIG. 10*a*, truss chords 420*c*, 420*d*, and 420*e* and sheathing panel 424 are illustrated. In the illustrated embodiment, truss chords 420*c*, 420*d*, 420*e* and sheathing panel 424 are the same as, or similar to, truss chords 20*c*, 20*d*, 20*e* and sheathing panel 24 shown in FIG. 6 and described above. However, in other embodiments, truss chords 420*c*, 420*d*, 420*e* and sheathing panel 424 can be different from truss chords 20*c*, 20*d*, 20*e* and sheathing panel 24. Truss chord 420*c* has a major face 442*b*, truss chord 420*d* has a major face 444*b* and truss chord 420*e* has a major face 446*b*.

Referring again to FIG. 10*b*, interconnecting portions 430*a*, 430*b* and 430*c* are illustrated. Part of interconnection portion 430*a* is positioned adjacent to the major face 442*b* of truss chord 420*c* and fastened to the truss chord 420*c* with one or more fasteners 467*a*. In a similar manner, interconnection portions 430*b*, 430*c* are fastened to the truss chords 420*d*, 430*e* respectively.

Interconnecting portion 430*a* has a first tab 431*a* spaced apart from a second tab 433*a*. Similarly, interconnecting portions 430*b*, 430*c* have first tabs 431*b*, 431*c* spaced apart from second tabs 433*b*, 433*c*. As will be discussed in more detail below, the first tabs 431*a*-431*c* are configured for attachment to the second tabs 433*a*-433*c*, thereby forming box-shaped insulation cavities.

Referring now to FIG. 10*b*, after the first interconnecting portion 430*a* has been fastened to the truss chord 420*c*, the first interconnecting portions 430*a* is bent or folded at a point below the first tab 431*a* and a span segment 436*a* is rotated in a counterclockwise direction such that second tab 433*a* aligns with the first tab 431*b* of the second interconnecting portion 430*b*. The second tab 433*a* and the first tab 431*b* are attached together with any desired fastener (not shown). In a similar manner, after the second interconnecting portion 430*b* is fastened to the truss chord 420*d*, the second interconnecting portion 430*b* is bent or folded at a point below the first tab 431*b* and a span segment 436*b* is rotated in a counterclockwise direction such that second tab 433*b* aligns with the first tab 431*c* of the third interconnecting portion 430*c*. The second tab 433*b* and the first tab 431*c* are attached together with any desired fastener (not shown).

Referring again to FIG. 10*b*, interconnecting portion 430*a* is bent such that a side panel segment 434*a* and the span segment 436*a* form an approximate right angle with each other. Also, the span segment 436*a* forms an approximate right angle with the side panel segment 434*b* of the second right member 430*b*. As shown in FIG. 10*b*, the approximate right angles formed between the side panels segments 434*a*, 434*b* with the span segment 436*a* defines a box-shaped insulation cavity 450*a*. In a repetitive manner, the interconnecting portions 430*b*, 430*c* are bent or folded such that first tabs 433*b*, 433*c* are connected to corresponding second tabs.

In one exemplary embodiment the interconnecting portions shown in FIGS. 10*a* and 10*b*, are formed from a rigid material structural cardboard material. The rigid material, such as structural cardboard material is configured to retain the box-like cross-sectional shape of the insulation cavity after the loosefill insulation material is distributed into the formed insulation cavities. In other embodiments, the interconnecting portions can be formed from other materials, such as the non-limiting example of reinforced fiberglass or polymeric-based materials sufficient to form a box-shaped insulation cavity. In still other embodiments, the interconnecting portions 430*a*-430*c* can be formed from flexible materials, such as for example, the netting 30 illustrated in FIG. 2*a* and described above. In this embodiment, the tabs of the flexible members 430*a*-430*c* can be fastened together in the same, or similar, manner as the tabs 38*a*, 38*b* illustrated in FIG. 5 and described above. In some exemplary embodiments, the interconnecting portions are made from more than one different material. For example, the span segments 436 may be made from a flexible material and the side panel segments 434 may be made from a rigid material. As another example, the span segments 436 may be made from an air barrier material, a vapor barrier material, and/or a vapor retarder material, while the side panel segments 434 are made from a breathable material, an open netting, or a mesh.

Referring again to FIG. 10*b*, insulation cavities 450*a*, 450*b* have a depth D400. The depth D400 is defined as the total of the depth D402 of the truss chords 420*c*-420*e* and the widths W9 of the material that extends below the truss chords. The widths W9 are adjustable such as to result in different depths D400 of the insulation cavities.

As further shown in FIG. 10*b*, a first insulation pocket 452*a* is formed as a portion of insulation cavity 450*a* and located under truss chord 420*d*. Similarly, other insulation pockets are formed as portions of the insulation cavities and are located under the truss chords. Distributing loosefill insulation material (not shown) into the insulation cavities results in loosefill insulation material filling the insulation pockets. As the filled insulation pockets are located below the truss chords, the filled insulation pockets are configured to insulate the truss chords.

Referring again to FIGS. 10*a*-10*b*, the boxed netting insulation system provides the same advantages as previously discussed, namely, a uniform thickness of the loosefill insulation material, the depth of the insulation cavities can be adjusted to provide different depths of the loosefill insulation material and insulation pockets positioned below the truss chords are filled with loosefill insulation material.

Figure 11A:
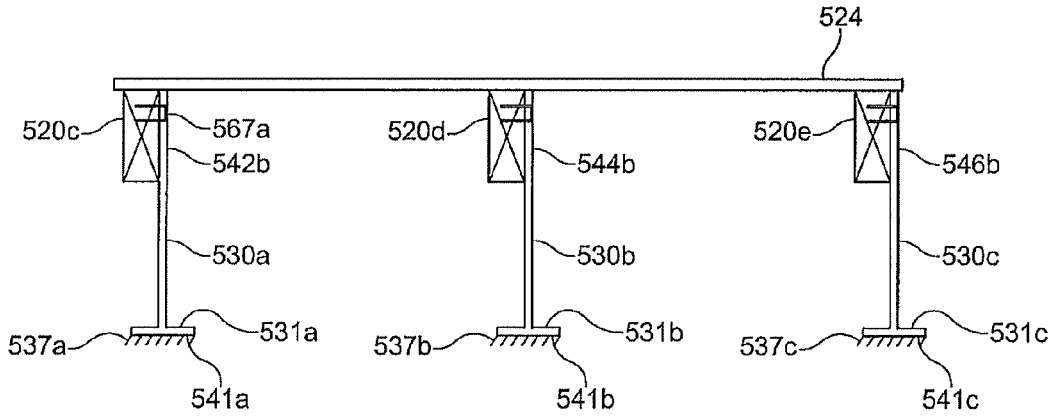
FIG. 11*a* is a partial front view, in elevation, of the building structure of FIG. 1 illustrating initial installation of rigid members for a sixth embodiment of a boxed netting insulation system.
Figure 11B:
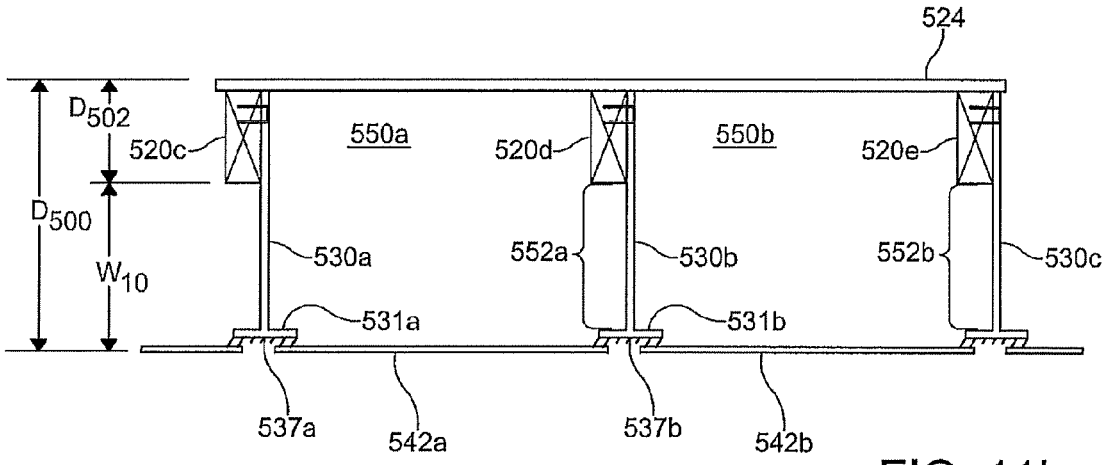
FIG. 11*b* is a partial front view, in elevation, of the building structure of FIG. 1 illustrating completed installation the rigid members of FIG. 11*a* for the sixth embodiment of a boxed netting insulation system.

Referring now to FIGS. 11*a* and 11*b*, another method of forming boxed insulation cavities is illustrated. Generally, this method entails use of T-shaped members and hook fasteners to form box-shaped insulation cavities.

Referring first to FIG. 11*a*, truss chords 520*c*, 520*d*, and 520*e* and sheathing panel 524 are illustrated. In the illustrated embodiment, truss chords 520*c*, 520*d*, 520*e* and sheathing panel 524 are the same as, or similar to, truss chords 20*c*, 20*d*, 20*e* and sheathing panel 24 shown in FIG. 6 and described above. However, in other embodiments, truss chords 520*c*, 520*d*, 520*e* and sheathing panel 524 can be different from truss chords 20*c*, 20*d*, 20*e* and sheathing panel 24. Truss chord 520*c* has a major face 542*b*, truss chord 520*d* has a major face 544*b* and truss chord 520*e* has a major face 546*b*.

Referring again to FIG. 11*a*, rigid members 530*a*, 530*b* and 530*c* are illustrated. A portion of rigid member 530*a* is positioned adjacent to the major face 542*b* of truss chord 520*c* and fastened to the truss chord 520*c* with one or more fasteners 567*a*. In a similar manner, portions of rigid member 530*b* and rigid member 530*c* are fastened to the truss chords 520*d*, 530*e* respectively.

Rigid member 530*a* has a segment 531*a* positioned at an end of the rigid member 530*a*. As shown in FIG. 11*a*, the rigid member 530*a* and the segment 531*a* have a cross-sectional shape of an inverted "T". As shown in FIG. 11*b*, the inverted T cross-sectional shape of the rigid member 530*a*, coupled with the netting 542*a* combine to form a boxed insulation cavity. While the embodiment shown in FIG. 11*a* illustrates the inverted "T" cross-sectional shape of the rigid member 530*a*, in other embodiments, the rigid member can incorporate other geometric cross-sectional shapes, such as for example, a simple "L" cross-sectional shape sufficient to combine with the netting 542*a* to form a boxed insulation cavity.

The segment 531*a* includes a plurality of "hook" fasteners 537*a* positioned on a major face 541*a*. As will be discussed in more detail below, the hook fasteners 537*a* are configured for attachment to a netting (not shown), thereby forming box-shaped insulation cavities. In a similar manner, rigid members 530*b*, 530*c* have segments 531*b*, 531*c* positioned at the ends of the rigid members 530*b*, 530*c*. The segments 531*b*, 531*c* include a plurality of "hook" fasteners 537*b*, 537*c* positioned on major faces 541*b*, 541*c*.

Referring now to FIG. 11*b*, after the rigid members 530*a*-530*c* have been fastened to the truss chords 520*c*-520*e*, a first netting 542*a* is positioned to span the segments 531*a*, 531*b* and engage the hook fasteners 537*a*, 537*b*, such that a tension is formed in the netting 542*a*. In a similar manner, subsequent nettings are positioned to span other segments and engage hook fasteners such that a tension is formed in each of the nettings. The tension imparted on the nettings results in the rigid members and the nettings forming insulation cavities 550*a*, 550*b* having box-like cross-sectional shapes that are substantially retained after loosefill insulation is blown into insulation cavities 550*a*, 550*b*.

In the illustrated embodiment, the nettings 542*a*, 542*b* constitute the "loop" portion of the hook and loop fastening to the rigid members 530*a*-530*c*. In certain embodiments, the material forming the nettings 542*a*, 542*b* can having naturally occurring loops sufficient to provide the loop function. In other embodiments, the material forming the nettings 542*a*, 542*b* can be roughened to form loops sufficient to provide the loop function. In still other embodiments, additional materials can be added to the nettings 542*a*, 542*b* sufficient to provide the loop function. One non-limiting example of an additional material is a strip of material having loops that is fastened to the nettings 542*a*, 542*b*.

In the embodiment shown in Figs. 11*a* and 11*b*, the rigid members are formed from a structural cardboard material. The structural cardboard material is configured to retain the box-like cross-sectional shape of the insulation cavity after the loosefill insulation material is distributed into the formed insulation cavities. In other embodiments, the rigid membranes can be formed from other materials, such as the non-limiting example of reinforced fiberglass or polymeric-based materials sufficient to form a box-shaped insulation cavity.

Referring again to FIG. 11*b*, insulation cavities 550*a*, 550*b* each have a depth D500. The depth D500 is defined as the total of the depth D502 of the truss chords 520*c*-520*e* and the width W10 of the rigid members that extend below the truss chords. The width W10 is adjustable such as to result in different depths D500 of the insulation cavities.

Referring again to FIG. 11*b*, a first insulation pocket 552*a* is formed as a portion of insulation cavity 550*a* and located under truss chord 520*d*. Similarly, other insulation pockets are formed as portions of the insulation cavities and located under the truss chords. Distributing loosefill insulation material (not shown) into the insulation cavities results in loosefill insulation material filling the insulation pockets. As the filled insulation pockets are positioned below the truss chords, the filled insulation pockets are configured to insulate the truss chords.

Referring again to FIGS. 11*a*-11*b*, the boxed netting insulation system provides the same advantages as previously discussed, namely, a uniform thickness of the loosefill insulation material, the depth of the insulation cavities can be adjusted to provide different depths of the loosefill insulation material and insulation pockets located below the truss chords are filled with loosefill insulation material, thereby insulating the truss cords.

Figure 12A:
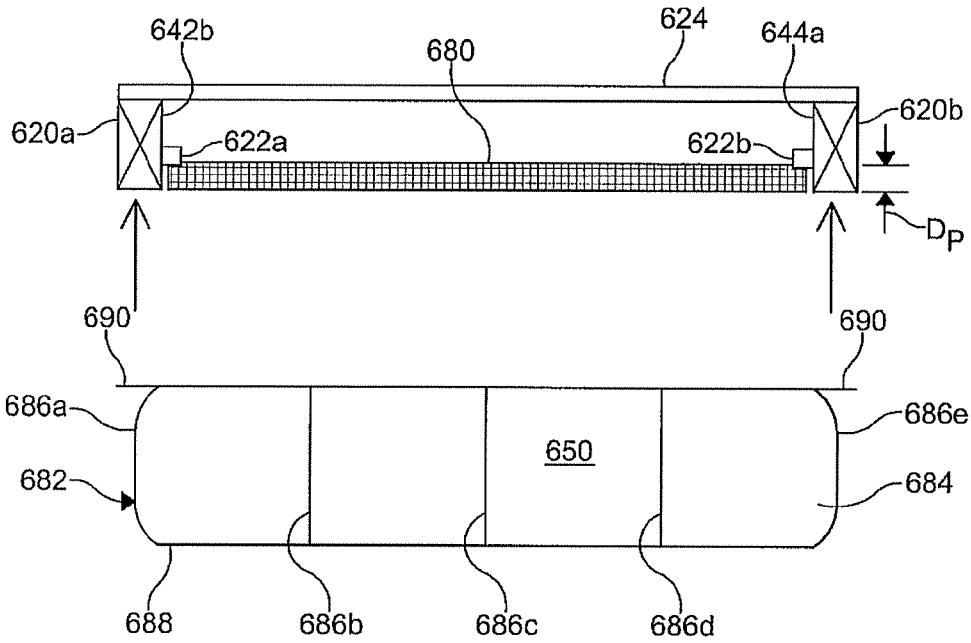
FIG. 12*a* is a partial front view, in elevation, of the building structure of FIG. 1 illustrating components for a seventh embodiment of a boxed netting insulation system.
Figure 12B:
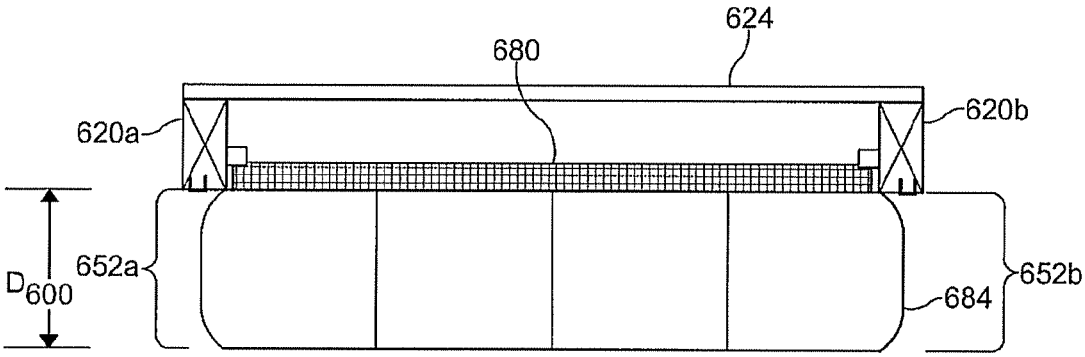
FIG. 12*b* is a partial front view, in elevation, of the building structure of FIG. 1 illustrating completed installation the components of FIG. 12*a* for the seventh embodiment of a boxed netting insulation system.

Referring now to FIGS. 12*a*-12*b*, another method of forming boxed insulation cavities is illustrated. Generally, this method entails use of shaped insulative containers to form box-shaped insulation cavities.

Referring first to FIG. 12*a*, truss chords 620*a* and 620*b* and sheathing panel 624 are illustrated. In the illustrated embodiment, truss chords 620*a*, 620*b* and sheathing panel 624 are the same as, or similar to, truss chords 20*c*, 20*d* and sheathing panel 24 shown in FIG. 6 and described above. However, in other embodiments, truss chords 620*a*, 620*b* and sheathing panel 624 can be different from truss chords 20*c*, 20*d*, 20*e* and sheathing panel 24. Truss chord 620*a* has a major face 642*b* and truss chord 620*b* has a major face 644*a*.

Referring again to FIG. 12*a*, in a first assembly step cleat 622*a* is fastened to the major face 642*b* of truss chord 620*a* by fasteners (not shown). The cleat 622*a* can be a continuous member that extends substantially the length of the truss chord 620*a* or the cleat 622*b* can constitute discontinuous segments. In a similar manner, cleat 622*b* is fastened to the major face 644*a* of truss chord 620*b* by fasteners (not shown). As will be explained below, the cleats 622*a*, 622*b* are configured as fastening supports for a panel 680. In the illustrated embodiment, the cleats 622*a*, 622*b* are wooden framing members having dimensions of 1.0 inch by 1.0 inch. However, in other embodiments the cleats 622*a*, 622*b* can be other structures and can be formed from other materials sufficient to provide fastening supports from the panel 680.

Referring again to FIG. 12*a*, the panel 680 is fastened to the cleats 622*a*, 622*b* by fasteners (not shown). In the illustrated embodiment, the panel 680 is formed from rigid foam insulation. The rigid foam insulation is configured to complement the insulative characteristics of the insulative containers. However, in other embodiments, the panel 680 can be any desired material, such as for example, plywood. The panel 680 has a depth DP such that in an installed position, a bottom face of the panel 680 is substantially flush with bottom faces of truss chords 620*a*, 620*b*.

Referring again to FIG. 12*a*, an insulative container 682 (hereafter "container") is illustrated. The container 682 is configured for attachment to the truss chords 620*a*, 620*b* and further configured to form a substantially box-shaped insulation cavity. The box-shaped insulative container is subsequently filled with loosefill insulation material.

Referring again to FIG. 12*a*, the container 682 includes an outer skin 684, a plurality of reinforcing ties 686*a*-686*e* and a reinforced bottom 688. In the illustrated embodiment, the outer skin 684 is the same as, or similar to, the netting 30 illustrated in FIG. 3 and described above. However, in other embodiments, the outer skin 684 can be different from the netting 30.

The reinforcing ties 686*a*-686*e* are configured to restrain expansion of the outer skin 684 during filling of the container 682 with loosefill insulation material, such that a filled container retains a box-like shape having a substantially planar lower surface. In the illustrated embodiment, the reinforcing ties are formed from reinforced fiberglass materials. In other embodiments, the reinforcing ties can be formed from other desired materials, such as for example, polymeric materials, sufficient to restrain expansion of the outer skin 684 during filling of the container 682 with loosefill insulation material, such that a filled container forms a box-like shape having a substantially planar lower surface.

Referring again to FIG. 12*a*, the container 682 includes a flange 690. Portions of the flange 690 extend beyond the outer skin 684 of the container 682. During assembly of the container 682 to the truss cords 620*a*, 620*b*, fasteners (not shown) are inserted through the portions of the flange 690 extending beyond the outer skin 684 of the container and into the truss chords 620*a*, 620*b*.

Referring now to FIG. 12*b*, a container 682 filled with loosefill insulation material is shown fastened to the truss chords 620*a*, 620*b* and adjacent to the panel 680. The container 682 forms a box-like cross-sectional shape with a substantially planar bottom surface. After the container 682 has been filled with loosefill insulation material, the reinforcing ties 686*a*-686*e* form a tension in the outer skin 684. The tension imparted on the outer skin 684 by the reinforcing ties 686*a*-686*e* results in the container 682 retaining a box-like cross-sectional shape.

Referring again to FIG. 12*b*, the insulation cavity 650 has an adjustable depth D600, such as to provide different insulative values.

As further shown in FIG. 12*b*, a first insulation pocket 652*a* is located under truss chord 620*a* and a second insulation pocket 652*b* is located under truss chord 620*b*. As shown in FIG. 12*b*, the containers 682 filled with loosefill insulation material, expand in a horizontal direction such as to overlap the insulation pockets 652*a*, 652*b*. When additional containers 682 are installed, the combination of expanded adjacent containers act to fill the insulation pockets 652*a*, 652*b* located under the truss chords.

Referring again to FIGS. 12*a*-12*b*, the boxed netting insulation system provides the same advantages as previously discussed, namely, a uniform thickness of the loosefill insulation material, the depth of the insulation cavities can be adjusted to provide different depths of the loosefill insulation material and insulation pockets located below the truss chords are filled with loosefill insulation material, thereby insulating the truss chords.

While the embodiments illustrated in FIGS. 1*a*-12*b*, have been described above as utilizing loosefill insulation material to fill insulation cavities, it is within the contemplation of this invention that other insulative materials could be used within the formed insulation cavities. Non-limiting examples of other insulative materials that can be used include insulation in the form of batts, rigid board insulation and insulation nodules formed from batts and rigid board insulation.

It is also within the contemplation of this invention that the various embodiments of the netting shown in FIGS. 1*a*-12*b* and discussed above include markings and/or indicia to aid an installer. Non-limiting examples of markings and/or indicia include positioning lines, stapling locations, and branding indications.

While the embodiments illustrated in Figs. 1*a*-12*b*, have been described as using individual sections of netting to form insulation cavities between adjacent truss chords, it should be appreciated that sections of netting can be configured to span more than one insulation cavity. For example, the netting could span adjacent insulation cavities or the netting could span any desired number of adjacent insulation cavities.

While the embodiments of the insulation cavities illustrated in FIGS. 1*a*-12*b* have been illustrated and described as being filled with loosefill insulation material, it is within the contemplation of this invention that the insulation cavities can be configured with one or more channels configured as conduits configured to provide fresh air to the attic. In certain configurations, the channels are simply spaces, void of loosefill insulation, within the insulation cavities. In other embodiments, the conduits can include structures or mechanisms, such as for example vents or fans, to facilitate the provision of fresh air.

While the embodiments illustrated in FIGS. 1*a*-12*b* illustrate the formation of box-shaped insulation cavities by fastening nettings, brackets and rigid members to truss chords, it should be appreciated that the boxed netting insulation system can be practiced by fastening nettings, brackets and rigid members to other structural members or framing members, such as for example roof decks, other faces of the truss chords or web members forming a truss system.

In accordance with the provisions of the patent statutes, the principle and mode of operation of the boxed netting insulation systems have been explained and illustrated in its preferred embodiment. However, it must be understood that the boxed netting insulation systems may be practiced otherwise than as specifically explained and illustrated without departing from its spirit or scope.

What is claimed is:

1. An insulation system comprising:

wooden structural members that are spaced apart;

sheathing panels disposed on top of the wooden structural members;

insulation support material comprising:

a plurality of single piece interconnecting portions, wherein each interconnecting portion comprises:

only one single side panel segment, wherein a width of the single side panel segment is greater than a depth of the structural members;

a single span segment connected to the single side panel segment and having a width that substantially matches the predetermined spacing of the structural members;

a tab at a transition from the single side panel segment to the single span segment;

wherein the tab of a first of the interconnecting portions is connectable to the single span segment of a second of the interconnecting portions to provide an insulation cavity;

wherein the side panel segments and the span segments define insulation cavities with pockets located directly under the bottommost surfaces of the wooden structural member, and insulation disposed in the pockets directly under the bottommost surfaces of the wooden structural members.

2. The insulation support material of claim 1 wherein the single side panel segment and the single span segment of each interconnecting portion are made from a flexible material that comprises a mesh or a plastic film.

3. The insulation system of claim 1 wherein at least one of the single side panel segments is made from a rigid material and at least one of the single span segments is made from a flexible material that comprises a mesh or a plastic film.

4. The insulation system of claim 1 wherein the single span segment of each interconnecting portion is made from a vapor retarder material.

5. The insulation system of claim 1 wherein the single span segment of each interconnecting portion is made from an air barrier material.

6. The insulation system of claim 1 wherein the single side panel segment of each interconnecting portion is made from an air pervious material, a breathable material, an open netting, or a mesh.

7. The insulation system of claim 1 wherein the single span segment of each interconnecting portion is made from a vapor retarder material and wherein the single side panel segment of each interconnecting portion is made from an air pervious material, a breathable material, an open netting, or a mesh.

8. The insulation system of claim 1 wherein the single span segment of each interconnecting portion is made from an air barrier material and wherein the single side panel segment of each interconnecting portion is made from an air pervious material, a breathable material, an open netting, or a mesh.

9. An insulation system comprising:

wooden structural members that are spaced apart;

sheathing panels disposed on top of top surfaces of the wooden structural members;

insulation support material comprising:

side panel segments attached to and extending past bottommost surfaces of the wooden structural members;

span segments supported below bottommost surfaces of the wooden structural members by the side panel segments; and wherein each span segment is connected to only one side panel segment;

wherein the side panel segments and the span segments define insulation cavities with pockets located directly under the bottommost surfaces of the wooden structural members; and insulation disposed in the pockets directly under the bottommost surfaces of the wooden structural members.

10. The insulation system of claim 9 wherein the side panel segments and the span segments are made from a flexible material that comprises a mesh or a plastic film.

11. The insulation system of claim 9 wherein the span segments each have a width that substantially matches the predetermined spacing of the trusses wooden structural members.

12. The insulation system of claim 9 wherein the side panel segments are made from a rigid material and the span segments are made from a flexible material that comprises a mesh or a plastic film.

13. The insulation system of claim 9 wherein the span segments are made from a vapor retarder material.

14. The insulation system of claim 9 wherein the span segments are made from an air barrier material.

15. The insulation system of claim 9 wherein the side panel segments are made from an air pervious material, a breathable material, an open netting, or a mesh.

16. The insulation system of claim 9 wherein the span segments are made from a vapor retarder material and wherein the side panel segments are made from an air pervious material, a breathable material, an open netting, or a mesh.

17. The insulation system of claim 9 wherein the span segments are made from an air barrier material and wherein the side panel segments are made from an air pervious material, a breathable material, an open netting, or a mesh.

18. The insulation system of claim 1 wherein the wooden structural members are angled.

19. The insulation system of claim 1 wherein the wooden structural members are truss chords.

20. The insulation system of claim 1 wherein each interconnecting portion further comprises a second tab at a free end of the single span segment.

21. The insulation system of claim 1 wherein a distance between the roof sheathing and the material of the single span segment of each interconnecting portion is substantially uniform.

22. The insulation system of claim 20 wherein the tab at the transition from the single side panel segment to the single span segment of the first interconnecting portion is connectable to the second interconnecting portion to provide an insulation cavity.

23. The insulation system of claim 9 wherein the wooden structural members are angled.

24. The insulation system of claim 9 wherein the wooden structural members are truss chords.

25. The insulation system of claim 1 wherein the single span segment of each interconnecting portion is made from an air pervious material, a breathable material, an open netting, or a mesh.

26. The insulation system of claim 9 wherein the span segments are made from an air pervious material, a breathable material, an open netting, or a mesh.

* * * * *